US006708010B2

(12) United States Patent
Miyabe et al.

(10) Patent No.: US 6,708,010 B2
(45) Date of Patent: Mar. 16, 2004

(54) DEVELOPING APPARATUS HAVING MAGNETIC SEAL

(75) Inventors: Shigeo Miyabe, Numazu (JP); Shinjiro Toba, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/133,673

(22) Filed: Apr. 29, 2002

(65) Prior Publication Data

US 2002/0172526 A1 Nov. 21, 2002

(30) Foreign Application Priority Data

Apr. 27, 2001 (JP) ..... 2001-131602
Apr. 22, 2002 (JP) ..... 2002-118856

(51) Int. Cl.[7] ..... G03G 15/08
(52) U.S. Cl. ..... 399/104; 102/103
(58) Field of Search ..... 399/102, 103, 399/104, 105, 106

(56) References Cited

U.S. PATENT DOCUMENTS 5,790,923 A 8/1998 Oguma et al. ..... 399/106
5,812,909 A 9/1998 Oguma et al. ..... 399/103
6,038,414 A * 3/2000 Inami et al. ..... 399/104
6,266,500 B1 7/2001 Numagami et al. ..... 399/104

* cited by examiner

*Primary Examiner*—Hoang Ngo
(74) *Attorney, Agent, or Firm*—Fitzpatrick, Cella, Harper & Scinto

(57) ABSTRACT

A developing apparatus includes a container, having an opening, for containing magnetic developer; a developer carrying member, rotatably disposed in the opening, for carrying the magnetic developer; a magnetic sealing member disposed spaced from a peripheral surface of said developer carrying member; and a removing member, disposed contacted to said developer carrying member, for removing the developer from the surface of said developer carrying member, said removing member being disposed adjacent an end, in a peripheral direction of said developer carrying member, of said magnetic sealing member, and a second sealing member for limiting movement or the developer from a space between said magnetic sealing member and said removing member toward a longitudinal end of said developer carrying member.

16 Claims, 20 Drawing Sheets

DEVELOPING APPARATUS HAVING MAGNETIC SEAL

FIELD OF THE INVENTION AND RELATED ART

The present invention relates to a developing apparatus for developing an electrostatic image, usable with an image forming apparatus such as a copying machine, a printer or the like of an electrophotographic type or an electrostatic recording type.

In developing means (developing apparatus) provided in the copying machine or printer, there is provided a sealing member for preventing leakage of the toner to outside of a developing zone at each end of a developer carrying member such as a rotatable developing roller of the developing apparatus. The sealing member for preventing the owner leakage is generally of felt, foam rubber or another elastic member.

The developing roller includes a magnet roller therein and is rotatably supported on a developing device frame through sleeve bearings. Therefore, the toner supplied from the developer container is deposited on the surface of the developing roller by the magnetic force of the magnet roller, and the thickness of a layer of the developer is regulated by a developing blade and is then fed to the developing zone where the developing roller is opposed to a latent image on the photosensitive drum by the rotation of the developing roller.

In addition, at a rear portion opposite from an opening side of the developing roller mounted to the developing device frame at each of the longitudinal ends of the developing roller outside the developing zone, an elastic sealing member is provided. The elastic sealing member is press-contacted to an outer surface of the developing roller to prevent leakage of the toner.

However, in the developing apparatus having such a structure, the elastic sealing member is press-contacted to one half of the outer surface of the developing roller, and therefore, the load of the developing roller against rotation thereof during the developing operation is large. By the contact to the developing roller, the elastic sealing member is deteriorated with results of insufficient sealing performance. Moreover, the toner, even if the amount thereof is small, enters between the developing roller and the elastic sealing member in some cases, with the result of increased torque or a large variation of the torque (non-uniform rotation). If this occurs, the image information is influenced.

In order to provide a solution to such problems, a proposal has been made to provide a magnetic sealing member (magnetic seal) with a predetermined gap at each end of the developing roller to prevent leakage of the toner.

The magnetic seal is made of a magnet, and is spaced from the outer surface of the developing roller with a predetermined gap (0.1–0.7 mm approx.) and wound around the developing roller. The magnetic sealing member is magnetized at the surface opposed to the developing roller to form a magnetic brush by the erected chains of toner particles along the magnetic lines of force. The magnetic brush fill the gap between the outer surface of the developing roller and the surface of the magnetic sealing member to prevent the toner from leaking out of the developing zone.

Since such a sealing method using the magnetic seal is based on the magnetic force the retain the toner in the gap between the magnetic sealing member and the surface of the developing roller, it is required to increase the magnetic flux density in the gap in order to enhance the sealing property. Particularly in the case that developing apparatus is of a cartridge type detachably mountable to the image forming apparatus, the toner leakage tends to occur due to vibration or shock upon the mounting and demounting operation thereof. Therefore, the magnetic force provided by the magnet for the magnetic seal has to be increased in such a case.

However, in the structure using the magnetic seal, a part of the toner in the gap between the magnetic seal and the surface of the developing roller comes out through the gap depositing on the surface of the developing roller by the rotation of the developing roller. By this, a toner layer is formed on the surface of the developing roller opposed to the photosensitive drum.

The toner is collected into an inlet portion of the gap by the further rotation of the developing roller, but if the magnetic flux density provided by the magnetic seal is high, the toner tends to stagnate at the inlet portion. With repetition of the developing operation, the amount of the stagnated toner gradually might increase even to such an extent that toner leaks to the outside of the developing apparatus.

In order to solve such a problem, U.S. Pat. Nos. 5,790,923 and 6,266,500 which have been assigned to the assignee of this application, proposes provision of a scraper for scraping the toner at the outlet of the gap between the magnetic seal and the surface of the developing roller to prevent the toner coming out through the gap between the magnetic seal and the surface of the developing roller from moving to the surface opposed to the photosensitive member.

However, in the case of apparatus in which the toner capacity is large in order to meet a large amount of prints, the amount of the toner scraped by the scraper with the result of gradually leaking out.

SUMMARY OF THE INVENTION

Accordingly, it is a principal object of the present invention to provide a developing apparatus capable of suppressing leakage of the developer.

It is another object of the present invention to provide a developing apparatus in which the developer stagnated in a space at the outlet of the magnetic sealing portions is effectively prevented from leaking out of the space.

According to an aspect of the present invention, there is provided a developing apparatus comprising a container, having an opening, for containing magnetic developer; a developer carrying member, rotatably disposed in the opening, for carrying the magnetic developer; a magnetic sealing member disposed spaced from a peripheral surface of said developer carrying member; and a removing member, disposed contacted to said developer carrying member, for removing the developer from the surface of said developer carrying member, said removing member being disposed adjacent an end, in a peripheral direction of said developer carrying member, of said magnetic sealing member; and a second sealing member for limiting movement of the developer from a space between said magnetic sealing member and said removing member toward a longitudinal end of said developer carrying member.

According to another aspect of the present invention, there is provided a developing apparatus comprising a container, having an opening, for containing magnetic developer; a developer carrying member, rotatably disposed in the opening, for carrying the magnetic developer; a magnetic sealing member disposed spaced from a peripheral surface of said developer carrying member; and a removing member, disposed contacted to said developer carrying member, for removing the developer from the surface of said developer carrying member, said removing member being disposed adjacent an end, in a peripheral direction of said developer carrying member, of said magnetic sealing member, wherein a surface facing the removing member and without facing to the peripheral surface of said developer carrying member of said magnetic sealing member includes two or more magnetic poles.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Referring to FIGS. 1–20, the description will be made as to Embodiments of the present invention.

DESCRIPTION OF THE PREFERRED EMBODIMENTS

In the following descriptions, the longitudinal direction means the direction parallel to the surface of the recording material and perpendicular to the feeding direction of the recording material. The longitudinal direction of the process cartridge is an axial direction of the developing roller, and is the same as the longitudinal direction when the process cartridge dismounted to the main assembly of the image forming apparatus.

(Process Cartridge and Main Assembly of Apparatus)

Figure 1:
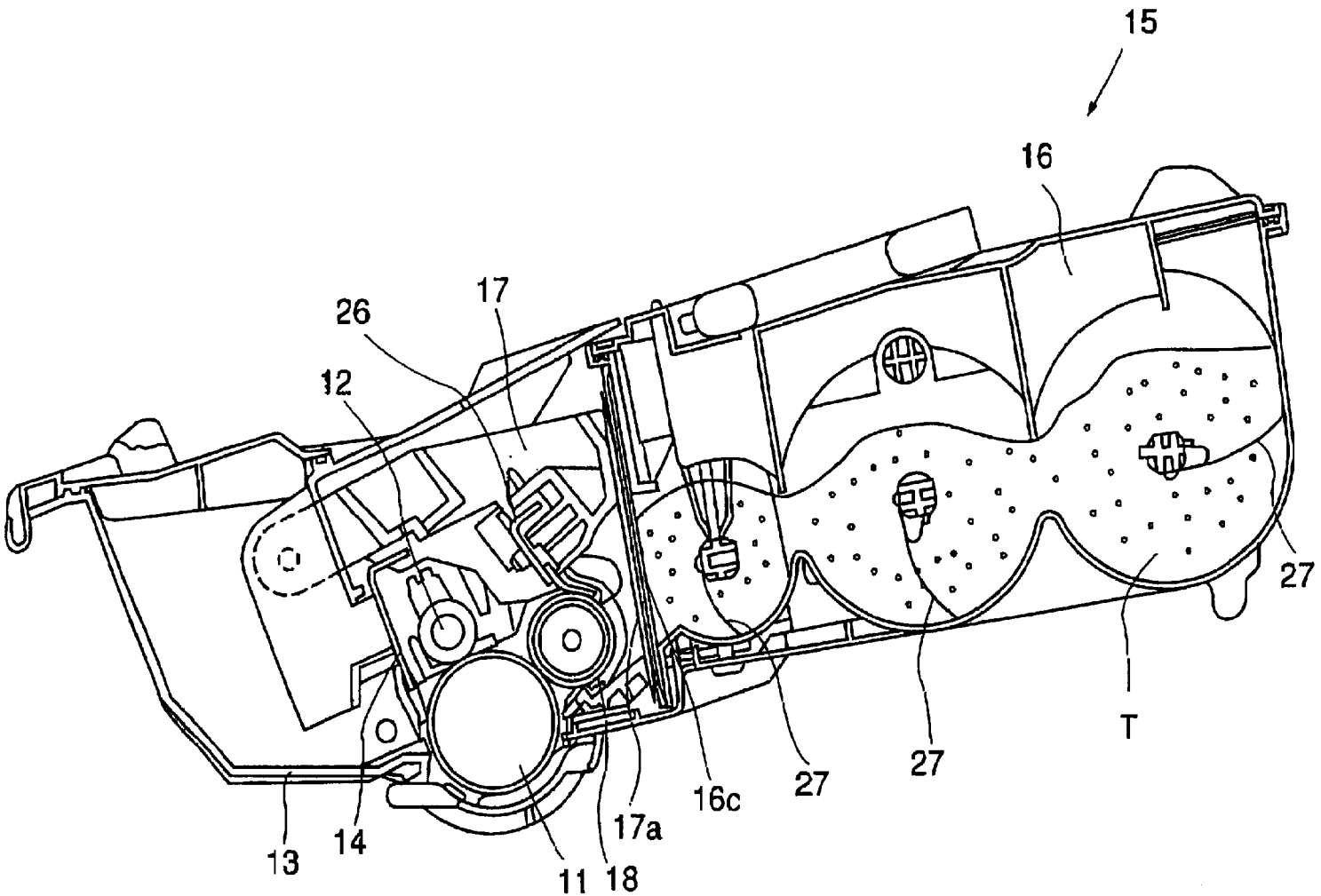
FIG. 1 is a main sectional view of a process cartridge according to an embodiment of the present invention.
Figure 2:
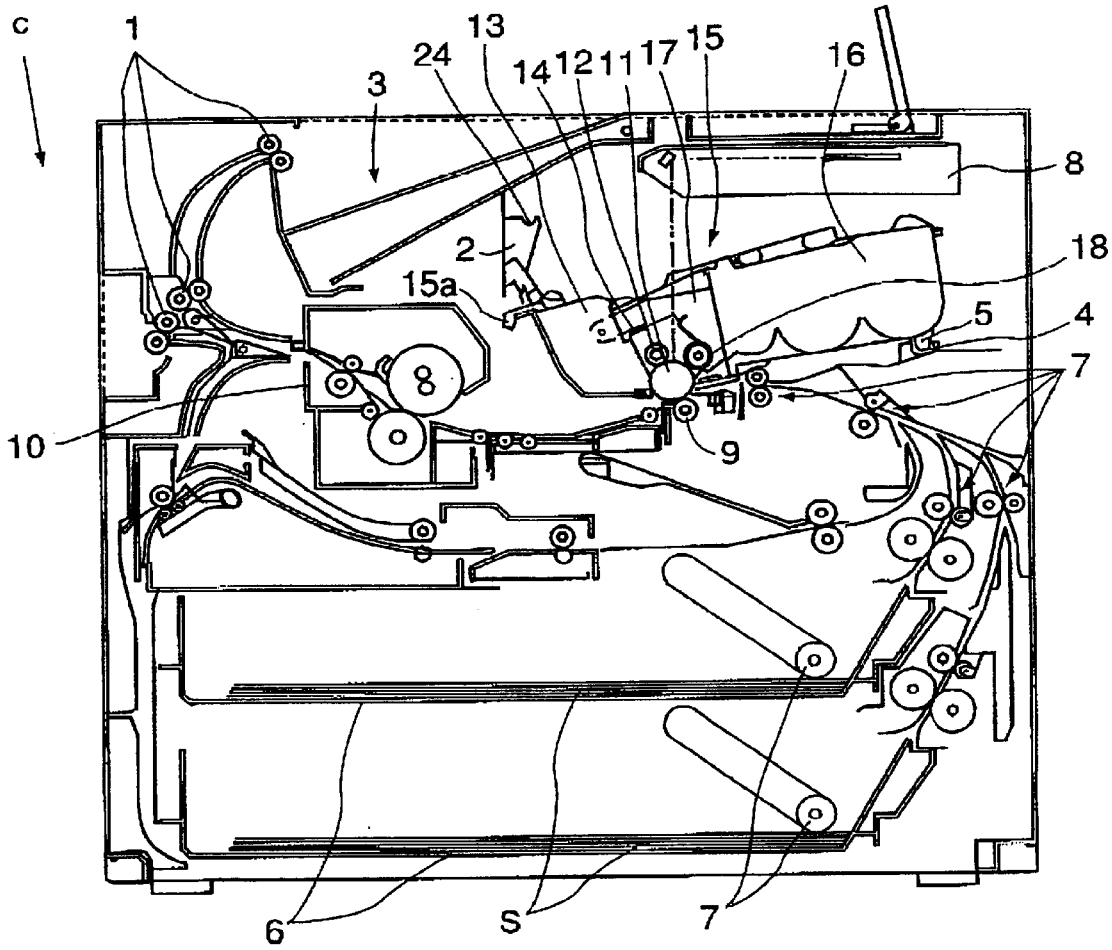
FIG. 2 is a main schematic sectional view of the main assembly of the apparatus according to an embodiment of the present invention.

FIG. 1 is a main sectional view of a process cartridge according to an embodiment of the present invention, and FIG. 2 is a main sectional view of an image forming apparatus according to an embodiment of the present invention. The process cartridge comprises an image bearing member and process means actable on said Image bearing member. The process means includes charging means for electrically charging the surface of the image bearing member, a developing apparatus for developing an image formed on the image bearing member into a toner image, and cleaning means for removing toner remaining on the surface of the image bearing member.

In the process cartridge 15 of this embodiment, around the image bearing member which is in the form of an electrophotographic photosensitive drum (photosensitive drum) 11, as shown in FIG. 1, there are provided a charging roller 12 (the charging means); a developing device including a developing roller 18, a developer regulating member 26 and a toner accommodation frame 16 accommodating the toner; and a cleaning blade 14 (the cleaning means). They are housed in a housing as a unit which is detachably mountable to the main assembly C of the image forming apparatus.

Figure 4:
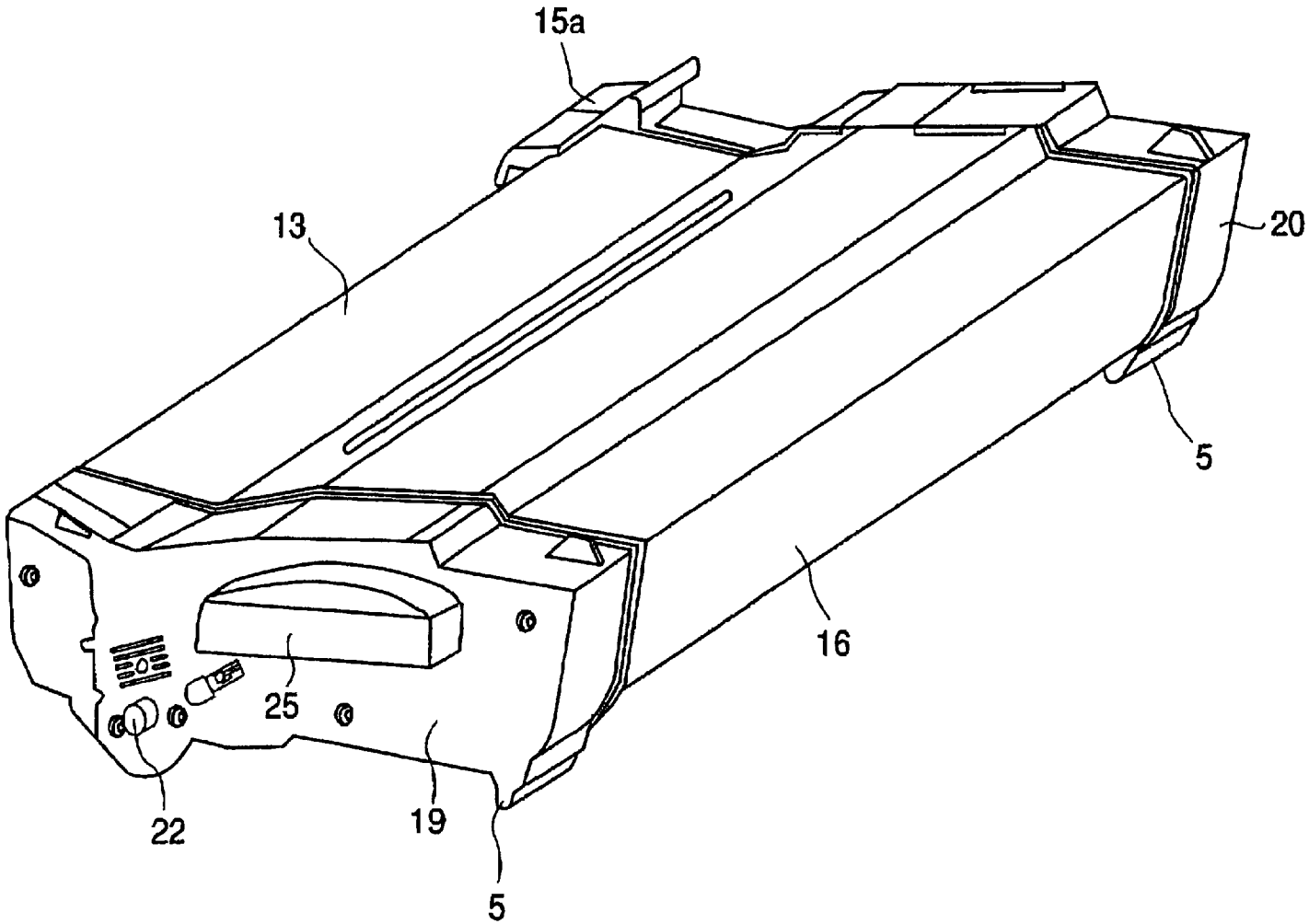
FIG. 4 is a perspective view of a process cartridge according to an embodiment of the present invention.

FIG. 2 shows a state in which the process cartridge 15 is placed in the main assembly C of the apparatus, and therefore, an image forming operation is capable. In order to remove the process cartridge 15, an arm 2 capable of supporting a left-hand end portion of the process cartridge 15 is lifted by an unshown handle by which the process cartridge 15 is rotated about a pivot leg 5 of the process cartridge 15 on a guide rail 4 of the main assembly C of the apparatus until the guide portion 15*a* of the process cartridge 15 is a line with the guiding rail 24 of the main assembly C of the apparatus. Then, the process cartridge 15 is pulled with a grip 25 (FIG. 4).

The mounting of the process cartridge 15 to the main assembly C of the apparatus is performed in the reverse order from the order described for removing the process cartridge.

The process cartridge 15 is mounted to the main assembly C of the image forming apparatus shown in FIG. 2 and is used for image formation. A sheet S (recording material) is fed out of a sheet cassette 6 disposed at a lower portion of the apparatus by a feeding roller 7. In synchronize with the sheet feeding, the light modulated in accordance with image information is projected from an exposure device 8 onto the photosensitive drum 11 which has been uniformly charged by the charging roller 12 so that electrostatic latent image is formed. On the other hand, the toner accommodated in the toner accommodation frame 16 is discharged to the developing roller 18 and is carried on the surface of the developing roller in a predetermined thickness regulated by a developer regulating member 26. By applying a developing bias to the developing roller 18, the latent image formed on the surface of the photosensitive drum 13 is developed. The toner image provided by the development is transferred onto a sheet S by bias voltage application to the transfer roller 9. The sheet S is then fed to the fixing device 10, where the transfer image is fixed. The sheet S is then discharged to the discharging portion 3 provided at an upper portion of the apparatus by the sheet discharging roller 1.

(Frame of Process Cartridge)

Figure 5:
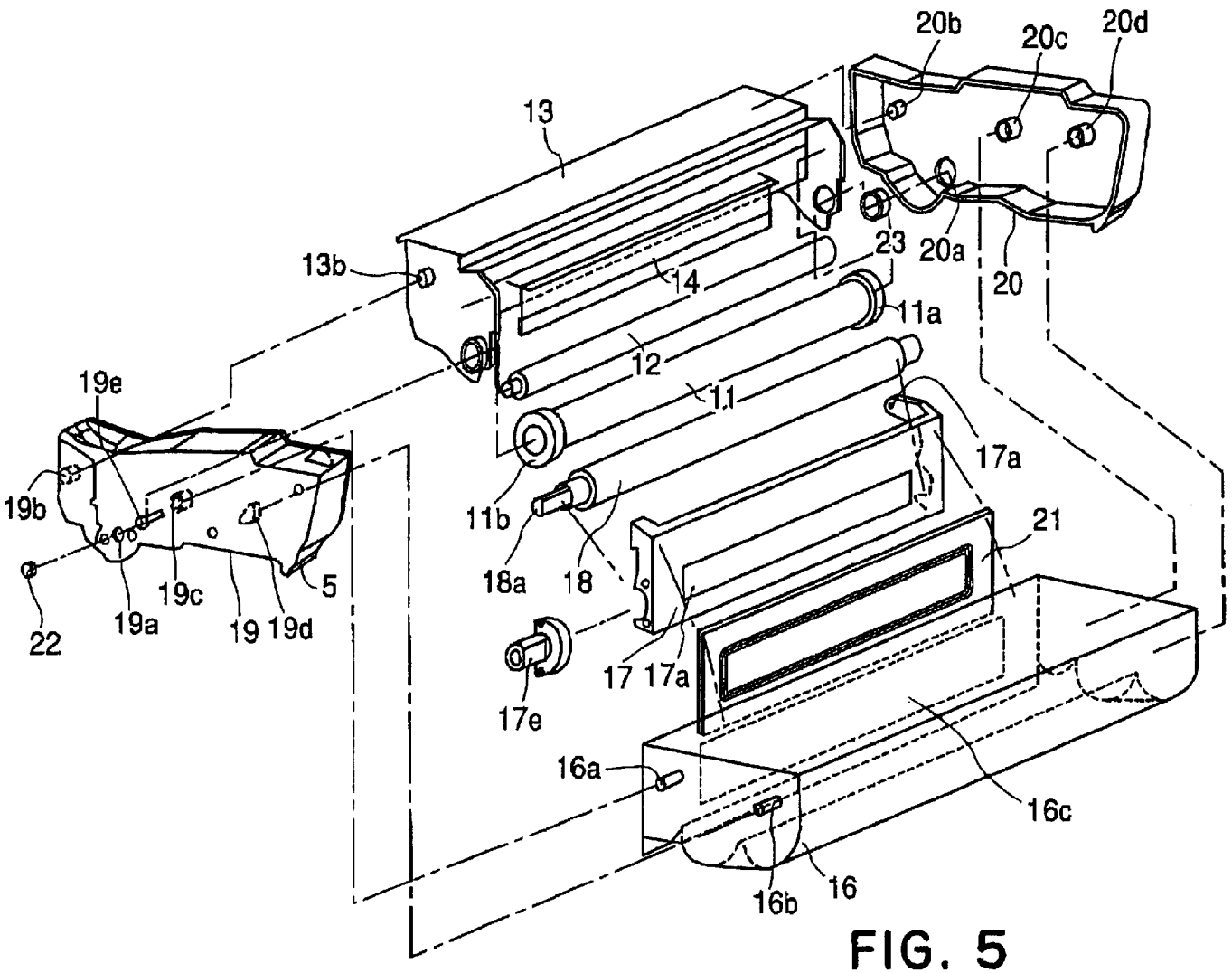
FIG. 5 is an exploded perspective view of a process cartridge frame according to an embodiment of the present invention.

Referring to FIGS. 1 and 3–5, the structure of the process cartridge 15 will be described. FIG. 5 is a perspective view of a frame before the process cartridge is assembled. The process cartridge 15 mainly comprises three frames, namely, a cleaning frame 13 integrally supporting the photosensitive drum 11, the charging roller 12, and cleaning blade 14; a developing device frame 17 integrally supporting the developing roller 18 and the developer regulating member 26 (not shown in FIG. 5 but shown in FIG. 1); a toner accommodation frame 16 accommodating the toner T. In addition, it comprises side covers 19, 20 at opposite and portions in order to integrally support the three frames to constitute the process cartridge.

Figure 3:
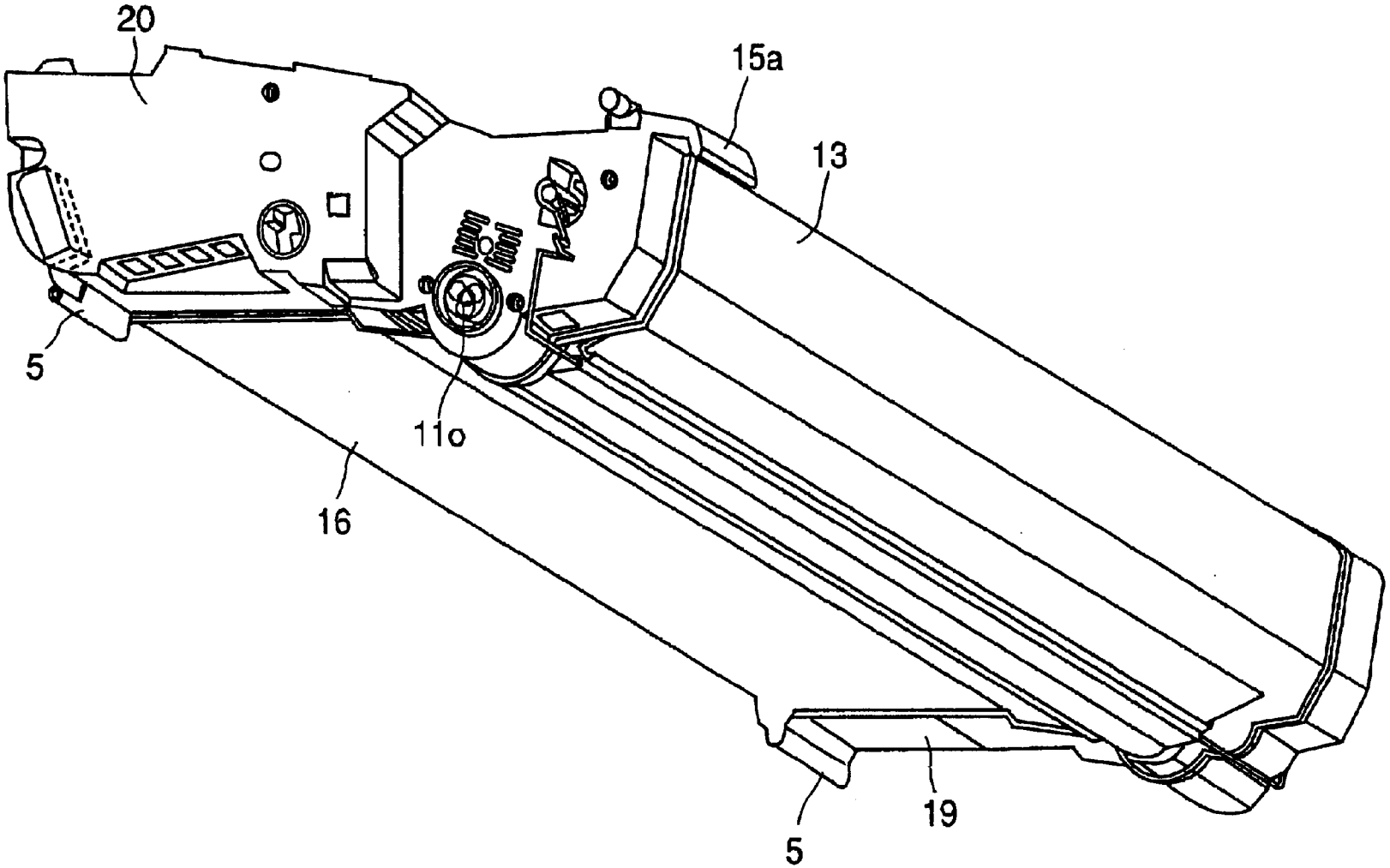
FIG. 3 is a perspective view of a process cartridge according to an embodiment of the present invention.

The cleaning frame 13 supports the cleaning blade 14 by small screws, and charging roller 12 is rotatably supported by bearing members (unshown) at the core metal portion at the end portions. The photosensitive drum 11 comprises, at the opposite end portions, respective flange portions 11*a*, 11*b* which are rotatably supported on the cleaning frame 13 by bearing members 22, 23. As shown in FIG. 3, the flange portion 11*a* has a so-called triangular coupling 11*c* for engagement with a driving coupling provided in the main assembly C of the apparatus at the end of the flange to receive a driving force from the driving device of the main assembly C of the apparatus in order to drive the photosensitive drum 11. The toner accommodation frame 16 has a toner feeding member 27 therein and accommodates the toner T.

In the developing device frame 17, there are provided a developing roller 18 containing therein a magnet roller 18*a*, a developer regulating member 26 and a magnetic seal (unshown). The developing roller 18 is rotatably supported by unshown bearings fixed to a projection 18 at one end and to the developing device frame 17 at the other end. The magnet roller 18*a* is supported by a projection 17C (developing roller shaft reception) at one end and by the developing device frame 17 at the other end so as to maintain a gap relative to the developing roller 18. The developing roller 18 is supplied with electric energy through all electrical contact provided in the developing roller 18. In addition, the developing roller 18 is provided with a roller (unshown) to maintain a constant gap relative to the photosensitive drum 11.

The developing device frame 17 is supported for rotation relative to the cleaning frame 13 in such a direction that center of the developing roller moves toward the center of the photosensitive drum about a hook hole 17*d* provided in the developing device frame 17 at the other side of the developing roller 18.

At a side of the developing device frame 17 at one end of the developing roller 18, a projection 17C is fixed on the axis of the developing roller 18 so as to press the projection 17C toward the center of the photosensitive drum. The projection 17C is inserted into a groove 19C provided in the side cover 19 (in this embodiment, a linear elongated hole extending substantially parallel toward the center of the photosensitive drum), so as to permit motion toward the photosensitive drum. In the groove 19C, there is an elastic member (unshown) to press against the projection 17C to urge that developing roller 18 to the photosensitive drum 11.

The groove 19C has also a positioning function for regulating the moving direction of the developing roller 18.

When the driving force is applied, unshown engageable gears provided on the photosensitive drum 11 and the developing roller 18, respectively, are urged toward each other to assure the engagement of the gears, thus preventing the force for disengaging the gears from each other. The developing roller 18 is normally pressed toward the photosensitive drum 18 by the elastic member provided in the groove 19C, too.

One of the side movers 19 has a size large enough to cover the main section of the process cartridge 15, and is disposed at one longitudinal end, and fixes the cleaning frame 13 and the toner accommodation frame 16 to integrally support them. The hole portion 19*a* of the side cover 19 is positioned coaxially with the center of the photosensitive drum, in the cleaning frame 13. The positioning of the side cover 19 using the bearing member 22 is advantageous since then the positioning is accurate. A positioning portion 19*b* of a dowel provided at a position as far as possible from the photosensitive drum 11 is engaged with the positioning portion 13*b* which is in the form of a hole provided in the side of the cleaning frame 13 to determine the position in the rotational direction. The side cover 19 and the cleaning frame 13 are fixed together by several screws. One end of the toner accommodation frame 16 is provided with positioning portions 16*a*, 16*b* for the dowel, and positioning portions 19*c*, 19*d* in the form of holes in the side cover 19 is engaged with the positioning portion, and the side cover 19 and the toner accommodation frame 16 are fixed together by several screws. The same applies to the side cover 20 at the other side.

As described hereinbefore, the bearing member 22 also functions to determine the position relative to the main assembly C of the image forming apparatus. In order to supply the toner from the toner accommodation frame 16 to the developer roller 18, the toner accommodation frame 16 and the developing device frame 17 are provided with openings 17*a*, 16*c*, respectively. There are connected by a sealing member 21 for connecting the openings 17*a*, 16*c* of the developing device frame 17 and the toner accommodation frame 16. The toner accommodation frame 16 is positioned by the side covers 19, 20, and the developing device frame 17 is positioned by the cleaning frame 13, and therefore, a deformation may occur due to dimension errors of the developing device frame 17 and the toner accommodation frame 16. Taking this into account, the sealing member 21 is made of a flexible material. With such a structure, even if the amount of the toner accommodated inn the toner accommodation frame 16 is large, the load of the toner is imparted on the side covers 19, 20 not on the developing roller 18. Therefore, the image formation is stable without imparting an unnecessary load to the photosensitive drum 11. By the connection of frames at the sides, the main body of the container can be correctly positioned by one part (side cover).

(Description of Developing Apparatus)

Figure 6:
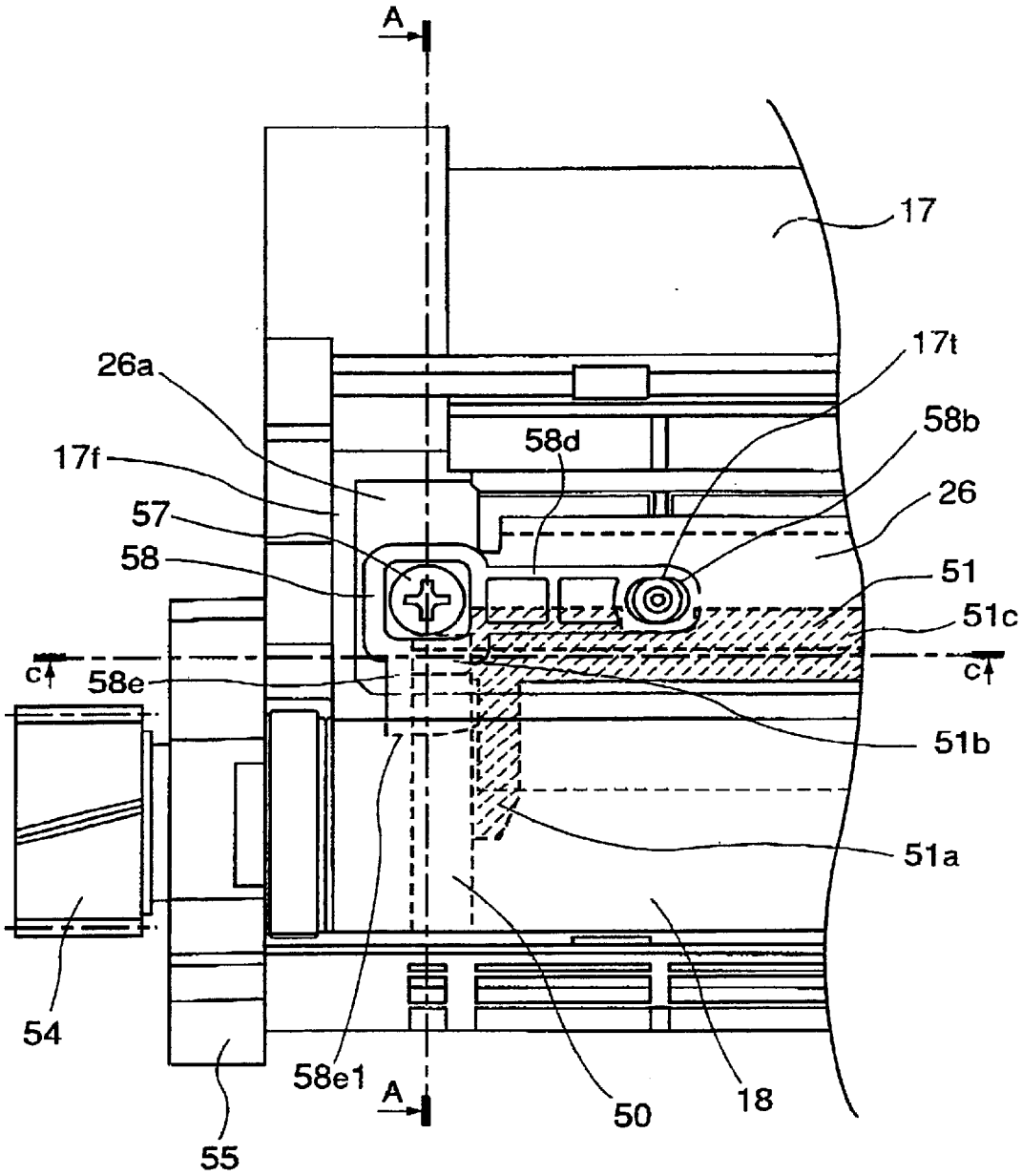
FIG. 6 is a front view of a developing apparatus.
Figure 7:
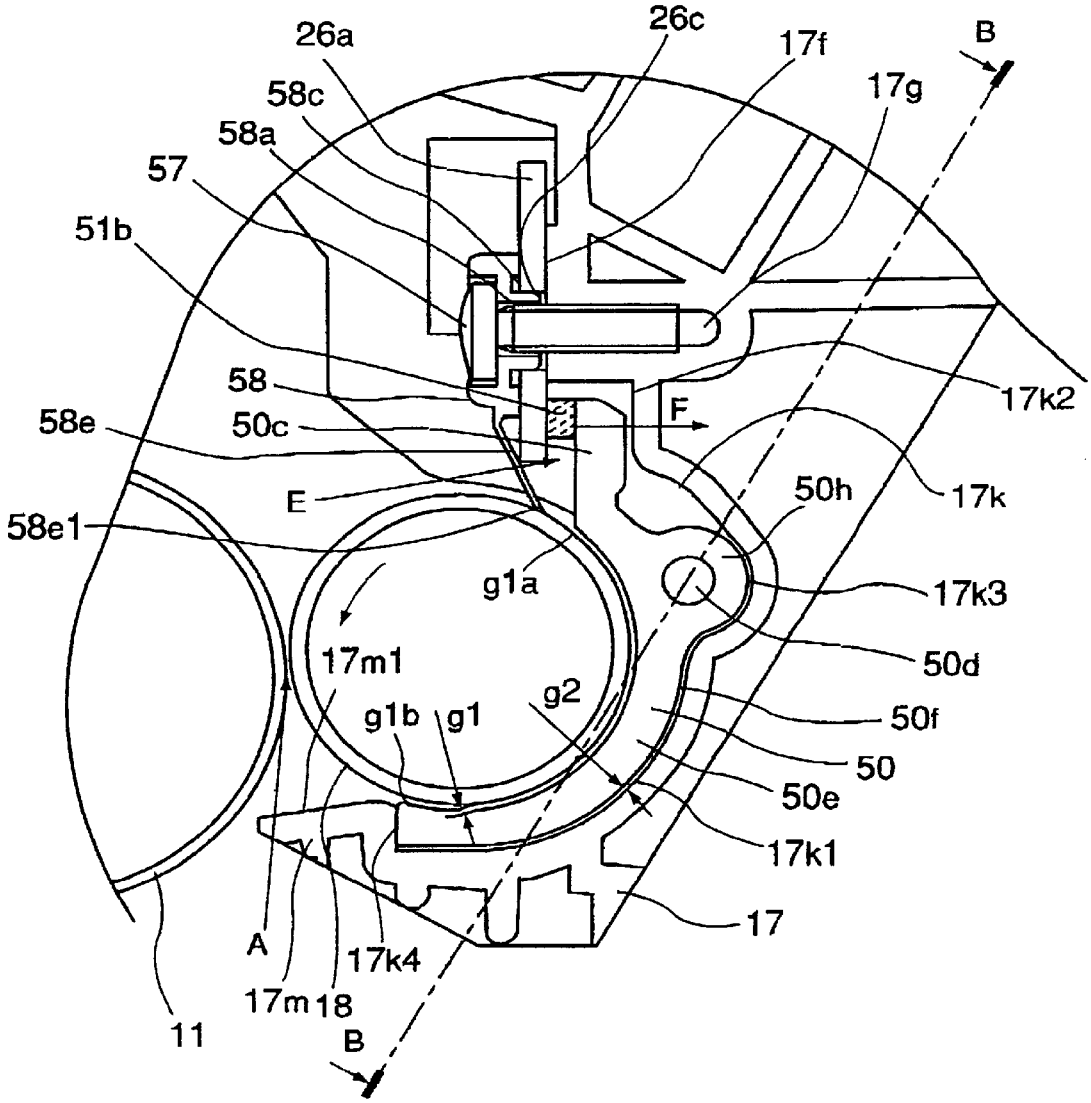
FIG. 7 is a sectional view taken along a line A—A in FIG. 6.
Figure 8:
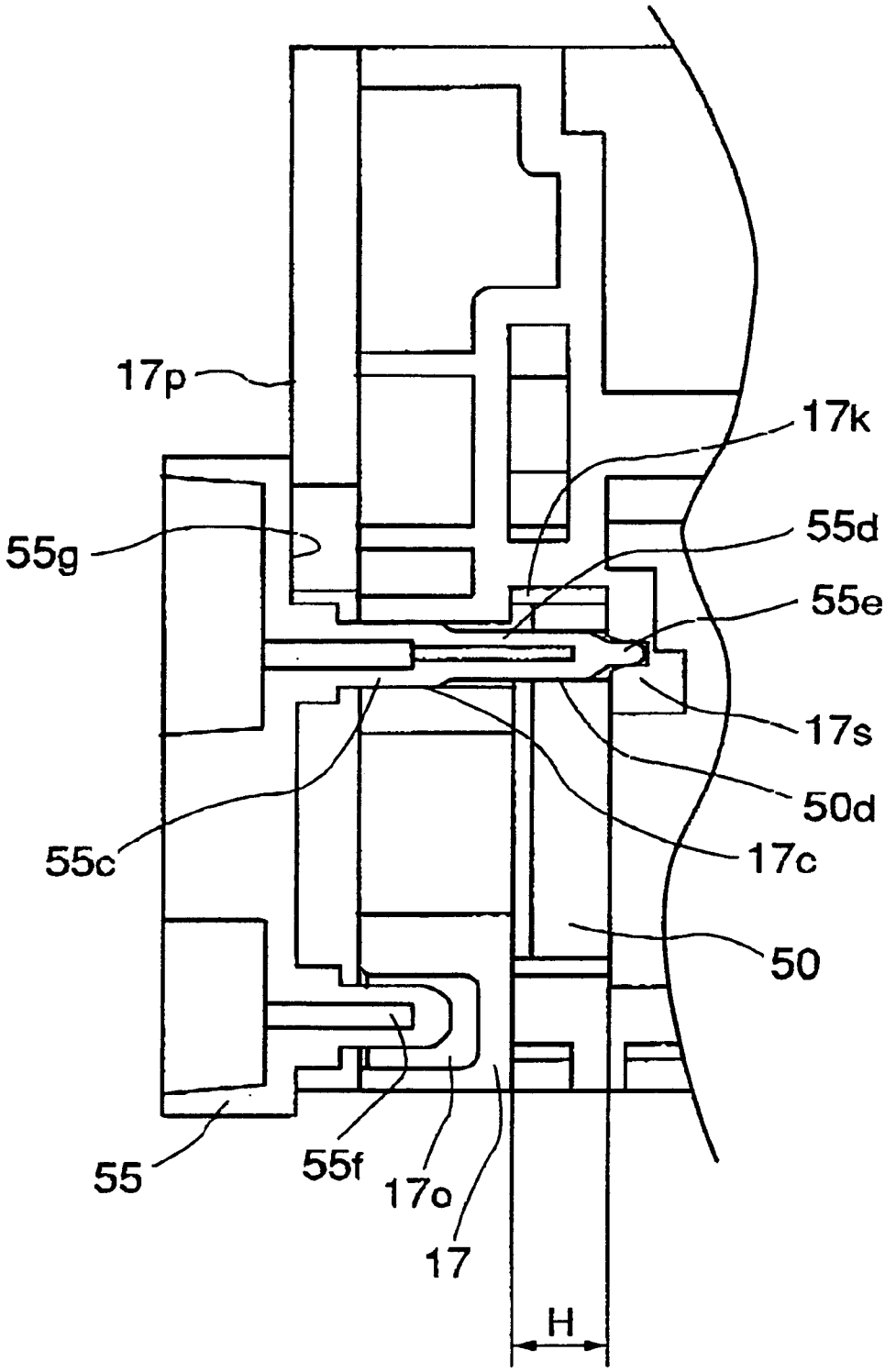
FIG. 8 is a sectional view taken along a line A—A in FIG. 6.
Figure 9:
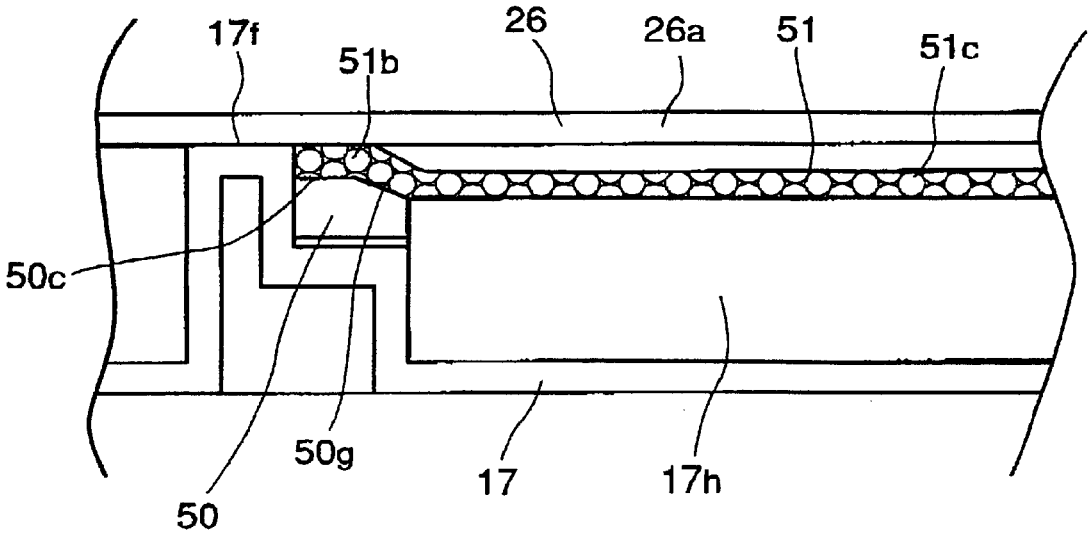
FIG. 9 is a sectional view taken along a line A—A in FIG. 6.
Figure 10:
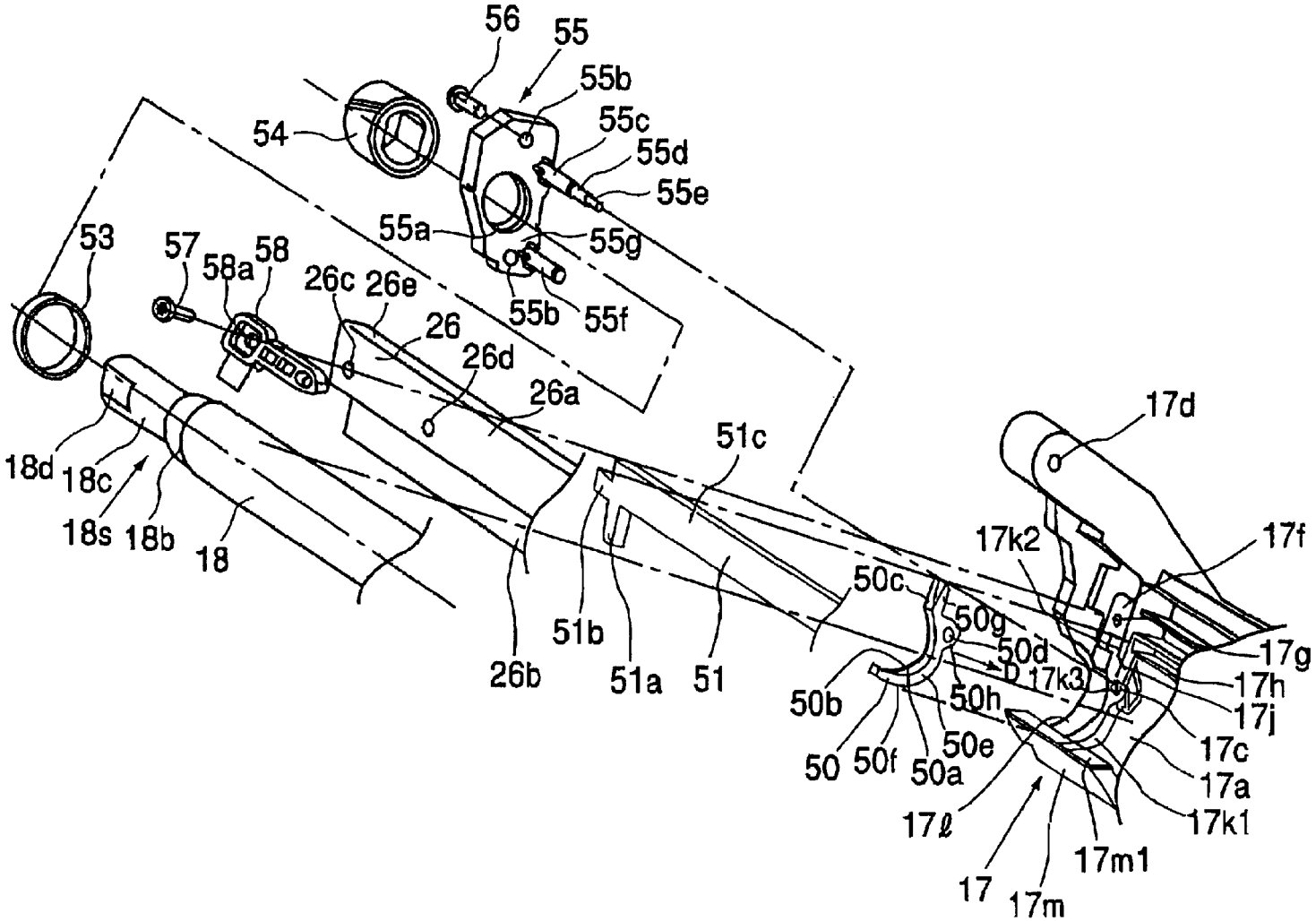
FIG. 10 is a perspective view of a developing apparatus in which parts are assembled.
Figure 11:
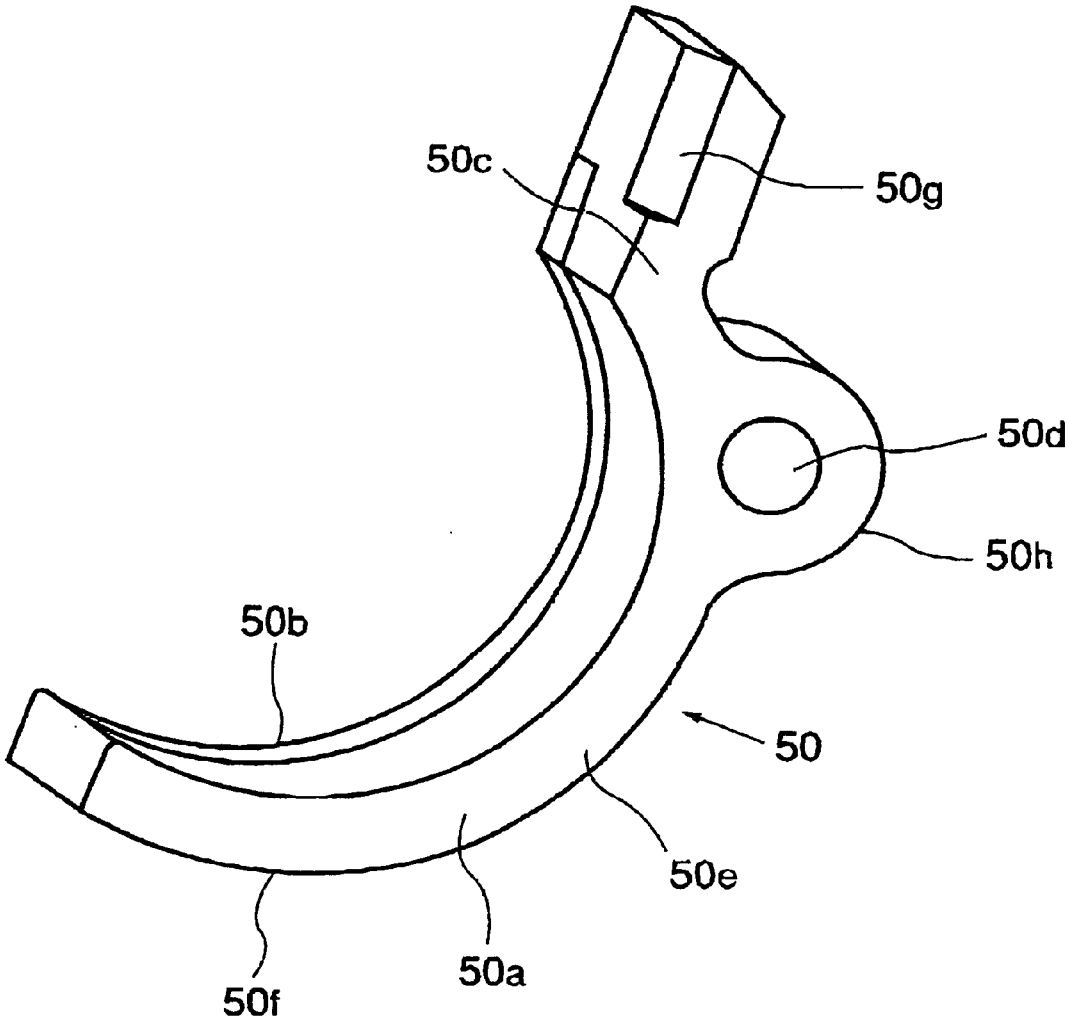
FIG. 11 is a perspective view of the magnetic sealing member per se.
Figure 12:
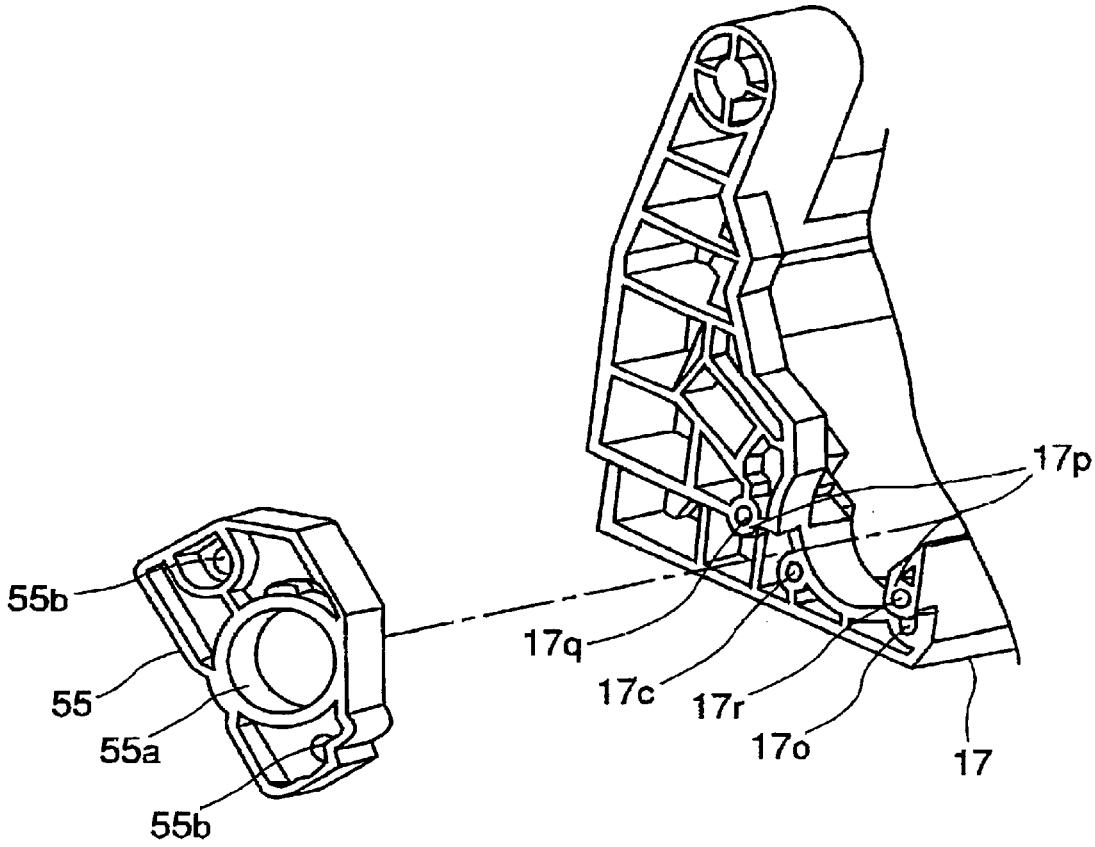
FIG. 12 is a perspective view of the development bearing frame and the developing device frame before they are assembled with each other.
Figure 13:
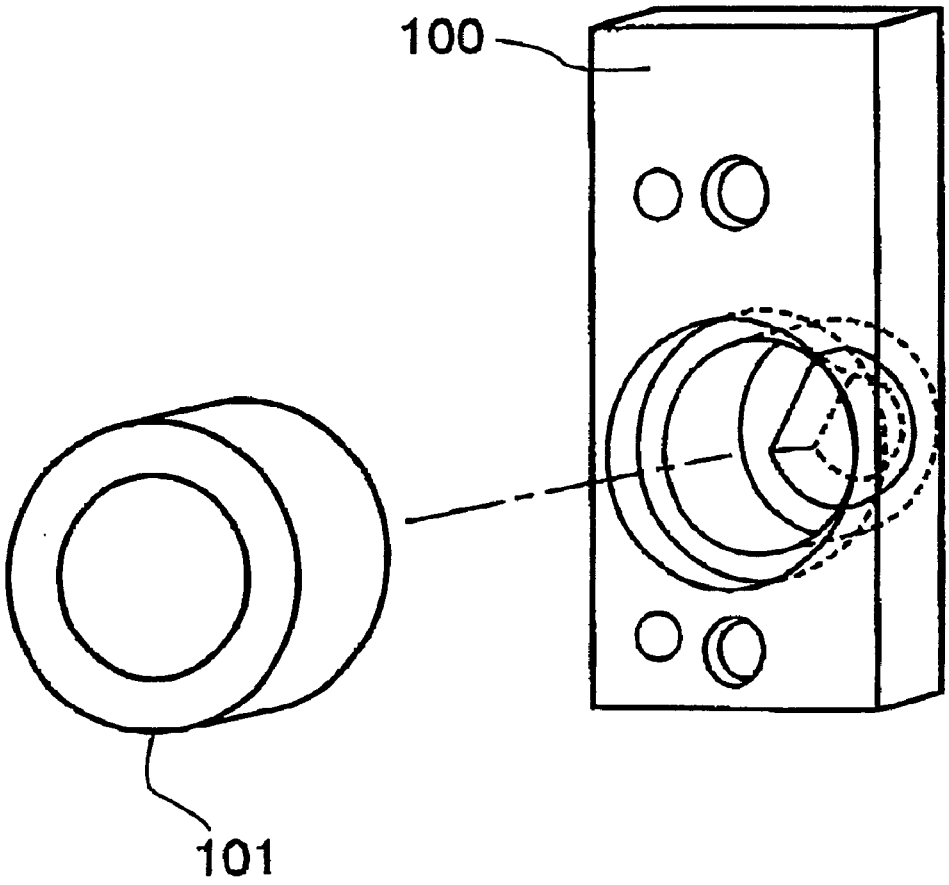
FIG. 13 is a perspective view of a development bearing frame of another example.
Figure 14:
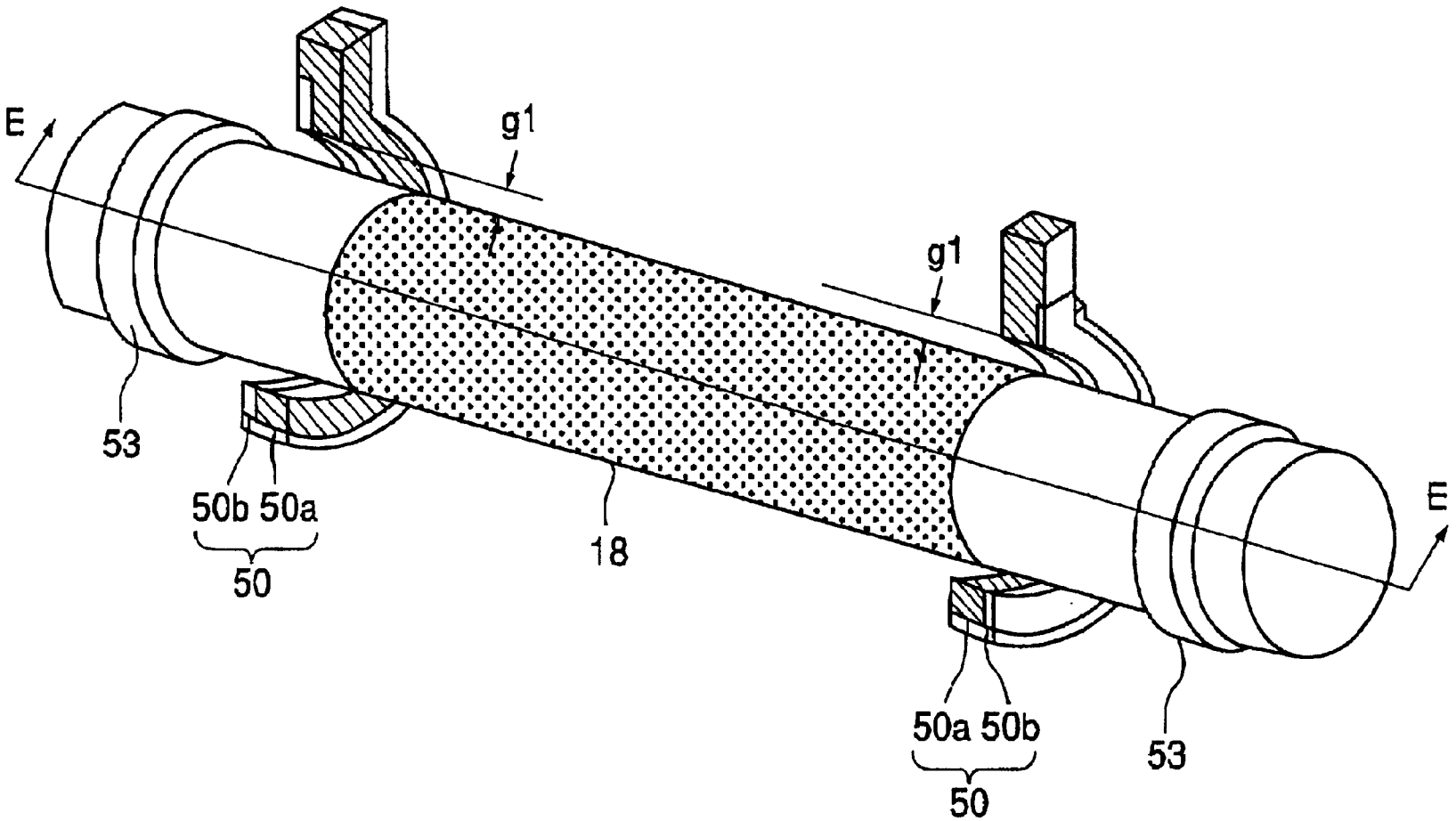
FIG. 14 is a perspective view of the developing roller and magnetic seal.
Figure 15:
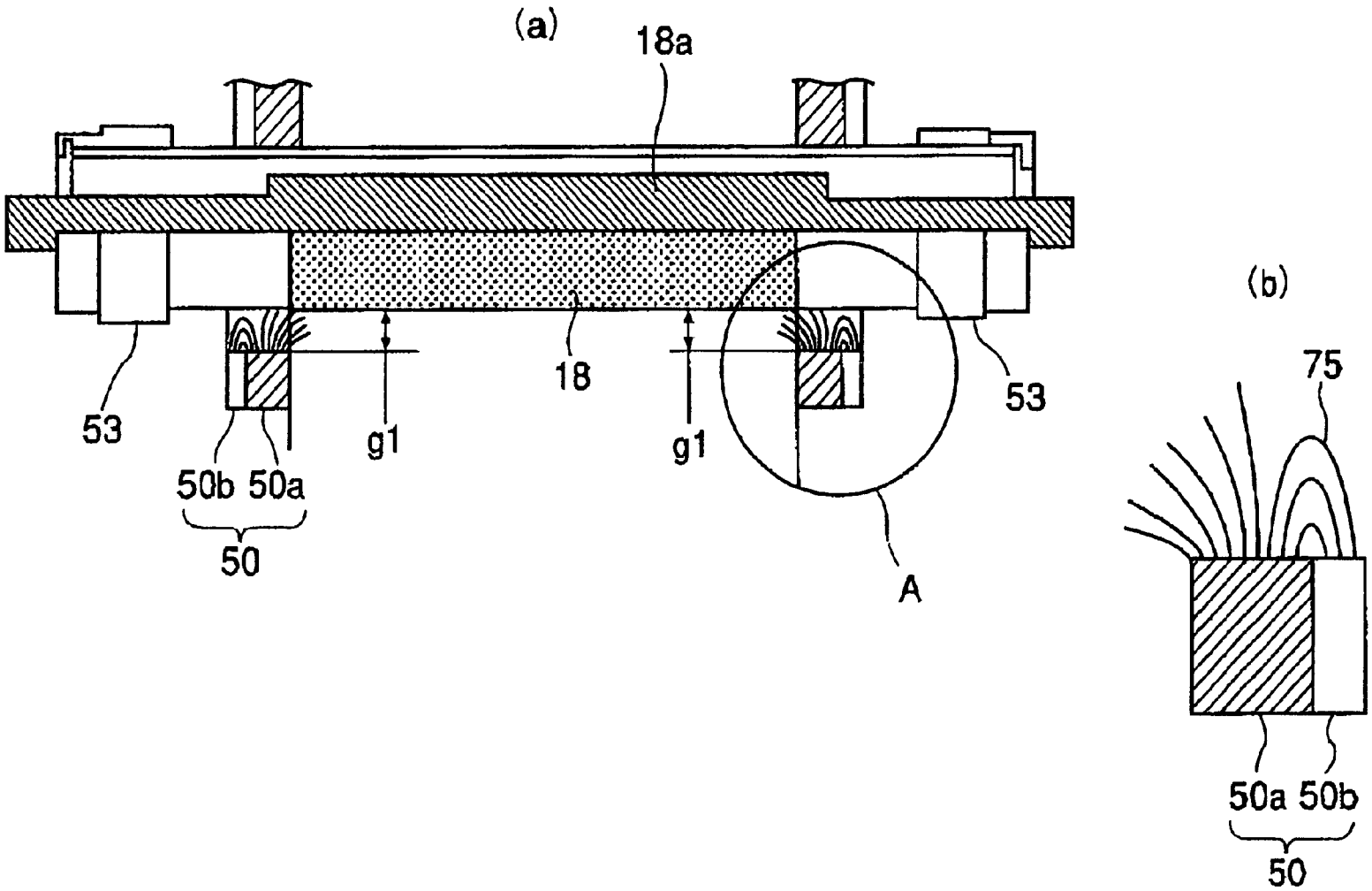
FIG. 15 is a sectional view taken along a line E—E in FIG. 14 (a), and an enlarged view of A part (b).
Figure 16:
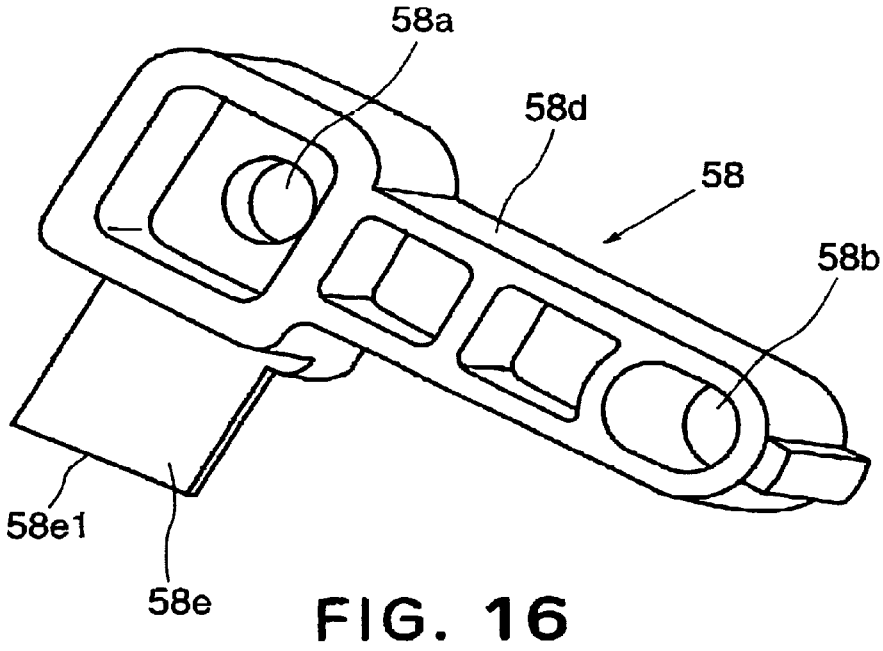
FIG. 16 is a perspective view of a toner scraping member per se.
Figure 17:
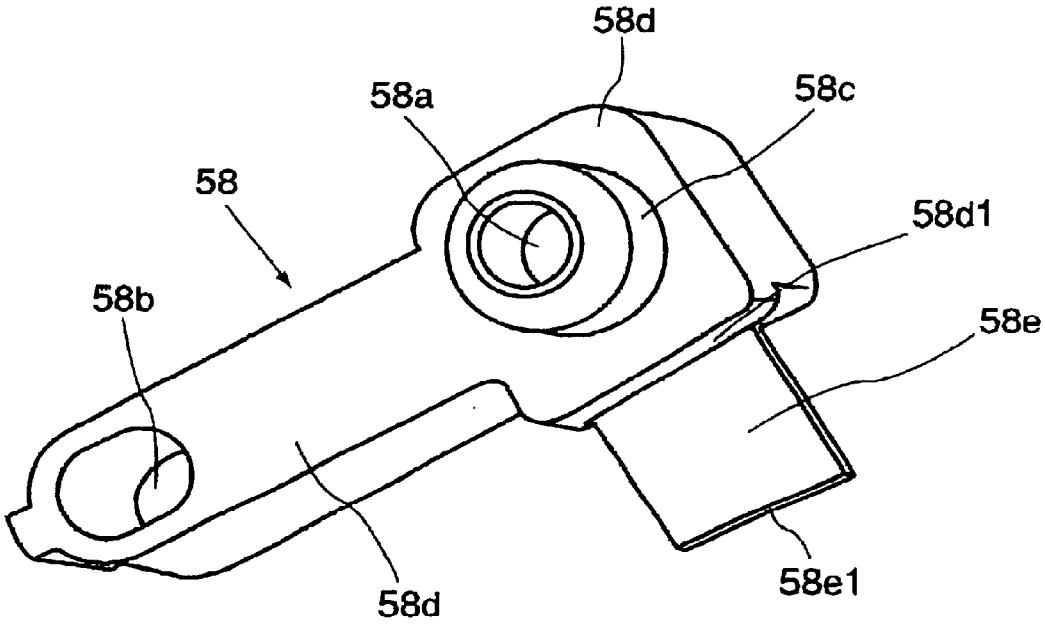
FIG. 17 is a perspective view as seen from a back side of FIG. 16.
Figure 18:
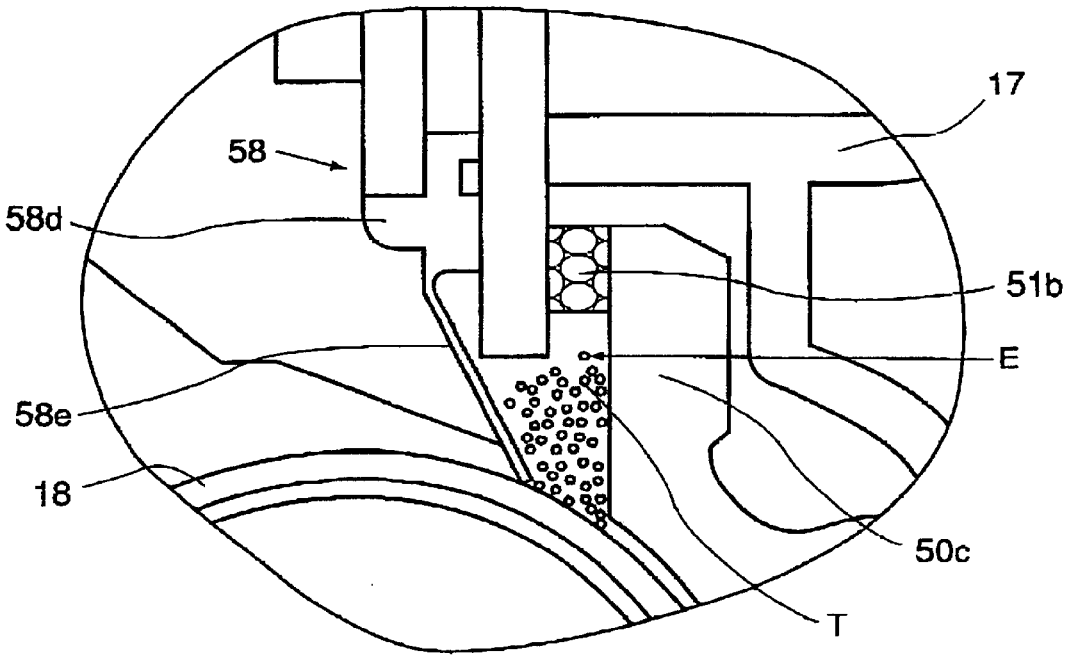
FIG. 18 is a sectional view illustrating stagnation of the toner in a toner retention portion in the case of long term use.
Figure 19:
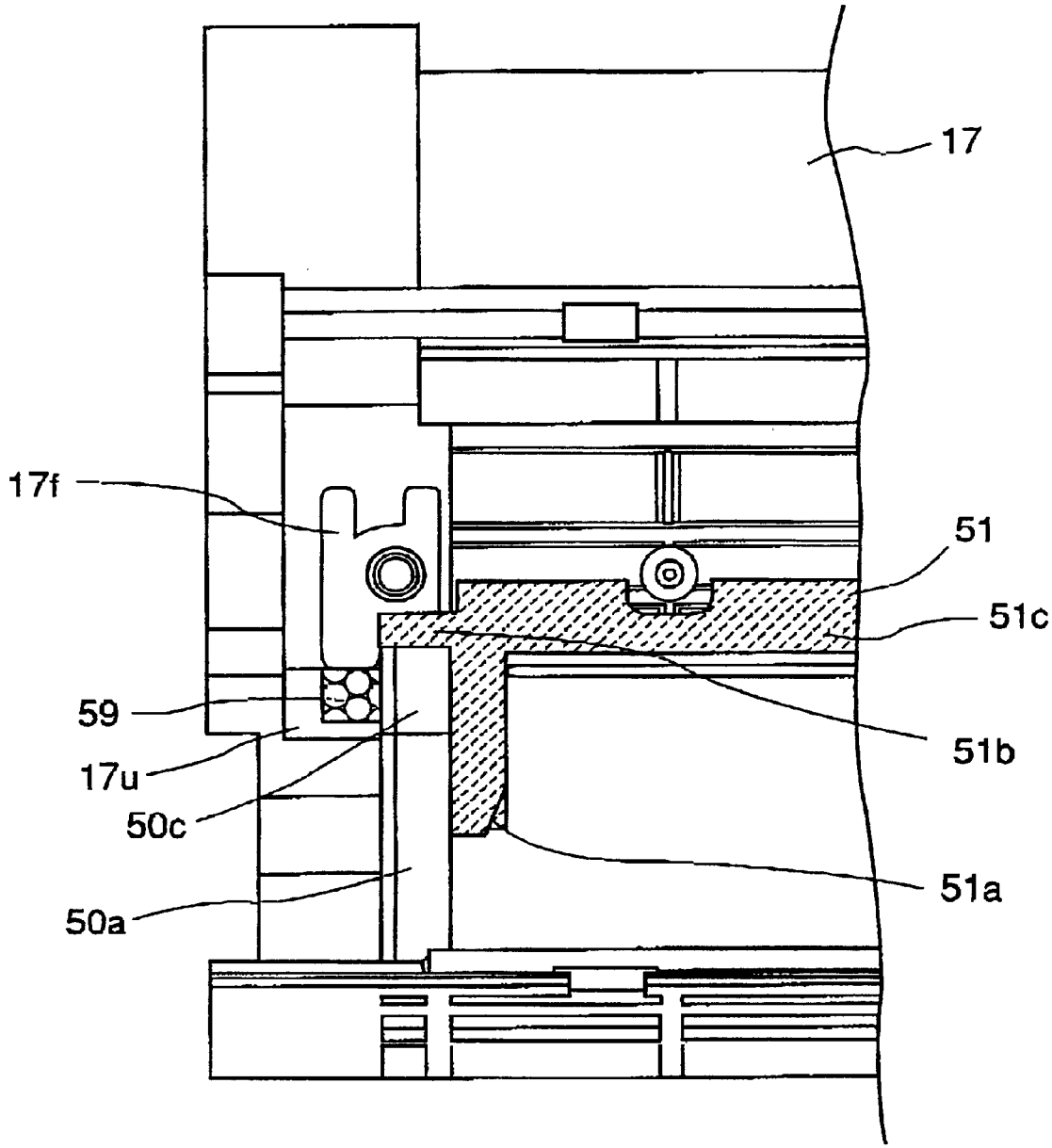
FIG. 19 is an illustration of a Loner leakage prevention in another example and is a front view of the developing apparatus as seen in the direction perpendicular to the longitudinal direction of the developing roller with the developing roller and developing blade omitted.
Figure 20:
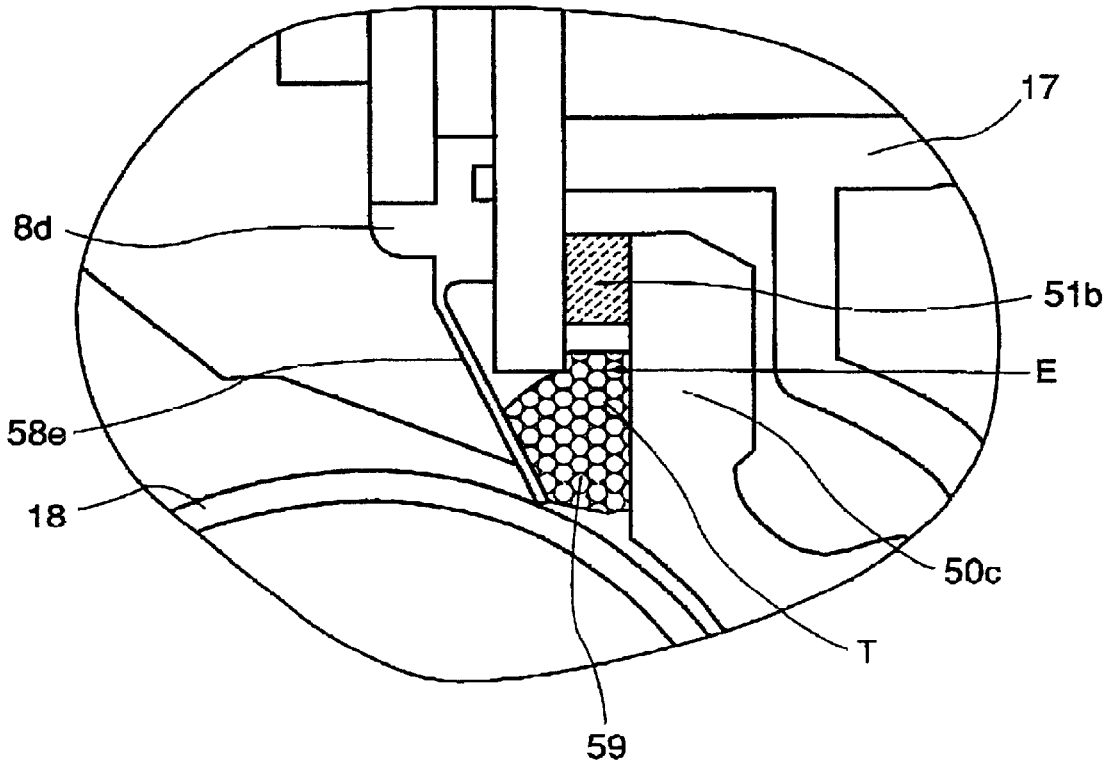
FIG. 20 is an illustration of toner leakage prevention of another example, and is a sectional view of a developing roller taken along a direction perpendicular to longitudinal direction.

Next, the developing apparatus will be described in more detail. FIG. 6 is a plan view of the one of the lengthwise ends of the development roller, and its adjacencies, as seen from the front side of the image forming apparatus. FIG. 7 is a sectional view of the development roller at a plane A—A in FIG. 6. FIG. 8 is a sectional view of the development roller, at a plane B-8 in FIG. 7. FIG. 9 is a sectional view of the development roller, at a plane C—C in FIG. 6. FIG. 10 is an exploded perspective view of one of the lengthwise ends of the development roller, and its adjacencies. FIG. 11 is a perspective view of a magnetic scaling member. FIG. 12 is a perspective view of a combination of a development roller bearing, and the lengthwise end of a developing means holding frame, before the former is attached to the latter. FIG. 13 is a perspective view of a combination of a development roller bearing and a development means holding frame, different from the one shown in FIG. 12. FIG. 14 is a perspective view of only a development roller and a pair of magnetic sealing members in such a manner that they will be positioned in a process cartridge. FIG. 15 is a sectional view of the combination of the development roller and the pair of magnetic sealing members, at a plane E—E in FIG. 14. FIGS. 16 and 17 are perspective views of a toner scraping member. FIG. 18 is a schematic sectional view of the development roller, toner scraping member, and their adjacencies, for showing the manner in which toner will have accumulated in a toner collecting space toward the end of the service life a process cartridge. FIGS. 19 and 20 are drawings for showing a toner leakage preventing method different from the preceding toner leakage preventing method. FIG. 19 being a plan view of one of the lengthwise ends or the developing apparatus (in which development roller and development blade are unshown), as seen from the direction perpendicular to the lengthwise direction of the development roller, and FIG. 20 being a sectional view of the development roller and its adjacencies, at a plane perpendicular to the lengthwise direction.

As described before, the development roller 18 and developer regulating member 26 (development blade), as image formation components, are attached within the developing means holding frame 17.

Referring to FIG. 10, the developer regulating member 26 comprises a blade supporting portion 26*a* formed of a piece of 1–2 mm thick metallic plate, and a developer regulating blade 26*b* fixed to the supporting portion 26*a* with the use of hot melt, two-sided adhesive tape, or the like. It is positioned so that the developer regulating blade 26*b* is placed in tangent to the development roller 18 to regulate the amount by which toner is coated on the peripheral surface of the development roller 18. The developer regulating blade 26*b* in this embodiment is formed of urethane rubber, but sometimes, silicone rubber is used as the material for the developer regulating blade 26*b*. The developing means holding frame 17 is provided with a flat surface 17*f*, as a blade anchoring portion, and a positioning joggle (unshown in FIG. 10; designated by referential code 17*t* in FIG. 6). The blade anchoring flat surface 17*f* is provided with a threaded hole 17*g*. The positioning joggle 17*t* is located slightly toward the center of the developing means holding frame 17 relative to the blade anchoring flat surface 17*f*. When attaching the development blade 26, the positioning joggle 17*t* is fitted into the positioning hole 26*d* of the blade supporting portion 26*a*. Then, the blade supporting portion 26*a* is solidly secured to the flat surface 17*f* by screwing a small screw 57 into the threaded hole 17*g* after putting it through the screw hole 58*a* of a developer removing member 58, as a toner scraping member, which will be described later, and also through the screw hole 26*c* of the blade supporting portion 26*a*. During this procedure, the joggle 17*t* is engaged in the elongated hole 58*b* of the developer removing member 58. In other words, the developer regulating member 26 and developer removing member 58 are attached to the developing means holding frame 17 with the same screw, or the small screw 57, fixing the position of the regulating edge of the developer regulating blade 26*b*, the amount of the pressure by which the developer regulating blade 26*b* is kept in contact with the development roller 18, and the distance between the regulating edge of the urethane rubber blade 26*b* to the interface between the development blade 26 (blade 26*b*) and development roller 18. As a result, development condition is established. Further, in order to increase the rigidity of the blade supporting portion 26*a* of the developer regulating member 26, the blade supporting portion 26*a* is bent 90 deg. at a predetermined line parallel to the lengthwise direction to form a rigidity increasing portion 26*e*.

Further, the developing means holding frame 17 is provided with a roughly U-shaped elastic sealing member 51 for preventing toner from leaking out. The elastic sealing member 51 is formed of MOLTPRENE, or the like, and is pasted to the elastic sealing member anchoring surfaces 17*h* and 17*j* (FIG. 10). The surface 17*h* is a part of the end surface of the rib which extends in the lengthwise direction along the top edge of the opening 17*a*, and the surface 17*j* extends downward (in FIG. 10) from the lengthwise end of the surface 17*h* in the direction perpendicular to the lengthwise direction. More specifically, the first straight portion 51*c* of the elastic sealing member 51 is pasted to the elastic sealing member anchoring surface 17*h* of the developing means holding frame 17, and the second straight portion 51*a* (third sealing member) of the elastic sealing member 51 is pasted to the elastic sealing member anchoring surface 17*j*. The elastic sealing member 51 is sandwiched between the developing means holding frame 17 and developer regulating member 26, being elastically compressed to prevent toner from leaking out. The elastic sealing member 51 is also provided with an ear-like portion 51*b*, which outwardly protrudes several millimeters in the lengthwise direction from the intersection of the first and second straight portions 51*a* and 51*c*. This ear-like portion 51*b* bears the role of positioning the magnetic sealing member 50, which will be described later, in addition to the role of preventing toner leakage.

Referring to FIG. 10, the magnetic sealing member 50 is attached to the developing means holding frame 17; more specifically, it is fitted in a groove 17*k* (FIG. 7), which is located at the lengthwise end of the opening 17*a*, and extends perpendicular to the lengthwise direction from the bottom edge of the opening 17*k* to the top edge of the opening 17*k*, following the arcuate surface 171, and further to the top end of the flat surface connected to the arcuate surface 171. This magnetic sealing member 50 will be described later in detail.

Further, the developing means holding frame 17 is provided with a thin elastic sealing member (unshown), which is pasted to the elastic sealing member anchoring surface 17*m*1 of the mandible-like portion 17*m* of the developing means holding frame 17, being placed in contact with the development roller 18, tangential to the peripheral surface of the development roller 18. The development roller 18 is a cylindrical member formed of a metallic substance such as aluminum, stainless steel, or the like. It is approximately 16–20 mm in diameter, and approximately 0.5–1 mm in thickness. Its peripheral surface has been coated with carbon, blasted, or subjected to the like to enhance the charging property of the developer. The development roller 18 in this embodiment was simply coated with carbon.

The development roller 18 is provided with a pair of sleeve flanges 18*s* (one of which is shown in FIG. 10), which are cylindrical members formed of a metallic substance such as aluminum, stainless steel, or the like, and are attached to the lengthwise ends of the development roller 18, one for one; they are pressed into the lengthwise ends of the development roller 18. The sleeve flange 18*s* is stepped, comprising a first cylindrical portion 18*b* and a second cylindrical portion 18*c*, the axial lines of which coincide with the axial line of the development roller 18. The first cylindrical portion 18*b* is greater in diameter than the second cylindrical portion 18*c*. Around the first cylindrical portion 18*b*, a spacer ring 53, which is a member for regulating the distance between the development roller 18 and photoconductive drum 11, and is formed of a dielectric material such as polyacetal or the like, is fitted. The second cylindrical portion 18*c* is fitted in the development roller bearing 55 (shown in FIG. 12, which is an enlarged perspective view of bearing 55, as seen from the direction opposite to the direction from which it is seen in FIG. 10), which is for rotationally supporting the development roller 18, as well as positioning the development roller 18 relative to the developing means holding frame 17. Further, the second cylindrical portion 18*c* is provided with a flatted portion 18*d*, which constitutes the end portion thereof. Around the second cylindrical portion 18*c* with this flatted portion 18*d*, a development roller gear 54 formed of synthetic resin is fitted, being prevented by the flatted portion 18*d* from rotating relative to the second cylindrical portion 18*c*. This development roller gear 54 is driven by a helical drum gear (unshown) attached to one of the lengthwise ends of the photoconductive drum 11, rotating thereby the development roller 18. Its teeth are twisted in such a direction that as it is rotated in mesh with the helical drum gear, thrust is generated in the direction to push the development roller 18 toward the center of the development roller 18 in terms of the lengthwise direction. Within the hollow of the development roller 18, a magnetic roll (reference code 18*a* in FIG. 15) for adhering toner to the peripheral surface of the development roller 18 is disposed. The sleeve flange 18*s* attached to the other end of the development roller 18 is similar in structure to the above described one, and its description will not be given here.

The developer roller bearing 55 is formed of lubricous resinous material, and is in the form of a piece of flat plate with a thickness of approximately 2–5 mm. This flat member, or the development roller bearing 55, has a cylindrical hole 55*a*, as the bearing portion, in its center portion, which is approximately 8–15 mm in diameter. In this bearing portion (hole) 55*a*, the second cylindrical portion 18*c* of the sleeve flange 18*s* is fitted, so that the development roller 18 can be rotationally driven. Further, the flat surface 55*g* of the development roller bearing 55 is provided with joggles 55*c* and 55*f*, and screw holes 55*b*. The joggles 55*c* and 55*f* are roughly parallel to the axial line of the bearing portion 55*a*, and contribute to the positioning of the bearing 55 relative to the developing means holding frame 17. The joggle 55*c* is stepped, its end portion forming a first cylindrical portion 55*d* slightly smaller in diameter than the base portion of the joggle 55*c*, and a second cylindrical portion 55*c* slightly smaller in diameter than the first cylindrical portion 55*d*. The axial lines of the first and second cylindrical portions 55*d* and 55*e* coincide with the axial line of the joggle 55*c*. The first and second cylindrical portions 55*d* and 55*e* of the joggle 55*c* are used for positioning the magnetic scaling member, which will be described later. The screw hole 55*b* is for securing the development roller bearing 55 to the developing means holding frame 17 with the use of small screws. The joggle 55*c* and 55*f* of the development roller bearing 55 are fitted in the positioning hole 17*c* (FIG. 12) and elongated hole 17*o*, respectively, and the flat surface 55*g* of the development roller bearing 55 is placed in contact with the surface 17*p* of the developing means holding frame 17. Then, the small screws 56 are put through the screw holes 55*b* of the development roller bearing 55 and screwed into the threaded holes 17*q* and 17*r* of the developing means holding frame 17, solidly securing the development roller bearing 55 to the developing means holding frame 17. This arrangement assures that as the developer regulating member 26 and development roller 18 are attached to the developing means holding frame 17, they are accurately positioned relative to each other for continuously outputting satisfactory images.

The second cylindrical portion 18*c* of the sleeve flange of the development roller 18 is slidably supported by the wall of the cylindrical bearing hole 55*a* of the development roller bearing 55. Therefore, a material superior in lubricity is required as the material for the development roller bearing 55, and such a material is relatively costly (for example, PPS or PA), which is a problem. This problem can be easily solved by dividing the development roller bearing 55 into a bushing portion 101, or the actual bearing portion, and a housing portion 100, so that the amount of highly lubricious material, or the costly material, necessary for providing the cylindrical bearing hole 55*a* with lubricious surfaces, can be reduced by using the highly lubricious material only for the bush portion 101, and using a relatively inexpensive material such as HIPS as the material for the housing 100.

(Magnetic Sealing Member)

The magnetic sealing member 50 (shown enlarged in FIG. 11) is 3–4 mm wide in terms of the lengthwise direction of the development roller 18. It comprises a magnet 50*a* and a magnetic plate 50*b*. The magnet 50*a* is formed of a mixture of magnetic powder (Nd—Fe—B powder) and nylon binder, by injection molding. The magnetic plate 50*b* is a piece of 1–1.5 mm thick steel. The magnet 50*a* and magnetic plate 50*b* are attached to each other during the injection molding (insert molding) so that the magnetic plate 50*b* becomes the corner portion of the magnetic sealing member 50 between the arcuate surface on the inward side, in terms of the radius direction of the arcuate portion of the magnetic sealing member 50, and the straight end surface on the inward side, in terms of the lengthwise direction of the development roller 18, and that the surfaces of the magnetic plate 50*b* and magnet 50*a* become flush with each other. However, even if the magnet 50*a* and magnetic plate 50*b* are put together using adhesive, two-sided adhesive tape, or simply held together by magnetism, certain effects, which will be described later, can be obtained. The gap provided between the development roller 18 and magnetic sealing member 50 is 0.1–0.7 mm. In this condition, the density of the magnetic flux from the magnetic sealing member 50 at the peripheral surface of the development roller 18 is 1,000–2,000 Gs. As for the positional relationship between the developing means holding frame 17 and magnetic sealing member 50, the magnet 50*a* is on the opening 17*a* (area corresponding to the center portion of the development roller 18 covered with dots in FIG. 14) side of the developing means holding frame 17 in terms of the lengthwise direction, whereas the magnetic plate 50*b* is on outward side (lengthwise ends of the development roller 18 in FIG. 14) of the magnetic sealing member 50.

With the positioning of the magnet 50*a* on the opening 17*a* side of the developing means holding frame 17, and the magnetic plate 50*b* on the outward side of the magnetic sealing member 50, in terms of the lengthwise direction of the development roller 18, the magnetic flux 75 from the magnetic sealing member 50 is concentrated between the magnet 50*a* and magnetic plate 50*b* as shown in FIG. 15(*b*), an enlarged view of the portion A in FIG. 15(*a*), and enters the magnetic plate 50*b,* which is high in permeability. In other words, the magnetic flux is prevented from spreading outward beyond the outward end surface of the magnetic sealing members 50 in terms of the lengthwise direction.

Therefore, it does not occur that toner is moved outward beyond the magnetic plate 50*b,* in terms of the lengthwise direction, by the magnetic force present at the surface of the magnetic sealing member 50. Therefore, It does not occur that toner is made to contact the spacer rings 53, that is, the distance regulating member, by the rotation of the development roller 18. Therefore, it is possible to reduce the distance between the spacer ring 53 and magnetic sealing member 50, which in turn makes it possible to reduce the size of the process cartridge C as well as the size of the image forming apparatus main assembly C.

Further, in terms of the lengthwise direction of a process cartridge, the toner on the magnetic sealing member 50 does not travel outward beyond the magnetic plate 50*b,* which is on the outward side of the opening 17*a* of the developing means holding frame 17; it is assured that the outwardly traveling toner is caught and held in the range in which the surface magnetism of the magnetic sealing member is strong. Therefore, even if the process cartridge 15 is subjected to shocks when the process cartridge 15 is mounted into, or dismounted from, the image forming apparatus main assembly C, the cartridge 15 remains well sealed; toner does not leak.

Attaching the magnetic plate 50*b* to the side surface of the magnet 50*a* causes a certain portion of the magnetic flux, which would simply diffuse if it were not for the magnetic plate 50*b,* to enter the magnetic plate 50 as described above, increasing the density of the magnetic flux at the surface of the magnet 50*a:* in other words, it increases the amount of magnetic force at the surface of the magnet 50*a,* improving the sealing performance of the magnetic sealing member 50, which in turn affords the usage of a weaker magnet, that is, an inexpensive magnet. In other words, the employment of a magnetic sealing member, such as the one in this embodiment, structured as described above, makes it possible to reduce cost.

(Developer Removing Member)

The aforementioned developer removing member 58 (shown enlarged in FIG. 16) as a toner scraping member comprises a main section 58*d* having a screw hole 58*a,* an elongated positioning hole 58*b,* a cylindrical positioning joggle 58*c,* and a blade 58*e* (FIG. 6). The main section 58*d* is roughly rectangular and approximately 3–5 mm in thickness. It has a few holes and recesses resulting from the removal of structurally unnecessary portions. It is disposed roughly in parallel to the developer regulating member 26 (FIG. 6). The blade 58*e* elastically contacts the development roller 18 in a manner to cover the entirety of the lengthwise end of the magnetic sealing member 50. It is relatively thin, having a thickness of 0.1–0.4 mm, and is attached to the end surface 58*d*1 of the main section 58*d,* by one of the edges.

Referring to FIG. 7, in terms of the moving direction of the peripheral surface of the development roller 18, the developer removing member 58 is disposed between the upstream end of the area A in which the latent image on the photoconductive drum 11 is developed, and the downstream end, that is, the exit end g1*a,* of the gap g1 between the magnetic seal 50 and the peripheral surface or the development roller 18, and adjacent to the exit end g1*a.* As described before, in terms of the lengthwise direction, the width of the blade 58*e* of the developer removing member 58 is approximately 1–3 mm wider than that of the magnetic sealing member 50, as shown in FIG. 6. The blade 58*e* of the developer removing member 58 is placed in contact with the development roller 18 so that it extends in the direction counter to the rotational direction of the development roller 18, and is tapered (at edge 58*e*1) so that as the development roller 18 rotates, the toner on the peripheral surface of the development roller 18 is scraped away toward the center of the development roller 18 in terms of the lengthwise direction (FIG. 6). Therefore, within the range of the magnetic sealing member 50 in terms of the lengthwise direction, toner is not left agglomerated in a layer on the portion of the peripheral surface of the development roller 18 on the area A side with respect to the blade 58*e.* Therefore, toner does not accumulate at the entrance portion g1*b* of the gap g1 between the magnetic sealing member 50 and the peripheral surface of the development roller 18, making It possible to employ a magnetic sealing member with a higher level of magnetic force in order to improve the sealing performance of the magnetic scaling member. Therefore, it is possible to provide a process cartridge which does not leak toner while it is used whether the cartridge is brand-new or has been in usage for a long time.

Incidentally, even though the blade 58*e* of the developer removing member 58 is in contact with the development roller 18, the contact area is very small. Therefore, the contact does not result in a significant amount of increase in the torque necessary to rotate the development roller 18. In other words, the provision of the above described developer removing member 58 does not significantly reduce the amount of decrease in the torque necessary to rotate the development roller 18, realized by the employment of the magnetic sealing member 50.

The developer removing member 58 is formed, with the use of injection molding, of synthetic resins, in particular, polyacetal, polycarbonate, polyphenylene oxide, or the like, which are superior in lubricity and are relatively small in the amount of permanent set resulting from fatigue.

As described before, the developer removing member 58 is solidly secured, along with the developer regulating member 26, to the developing means holding frame 17, with the use of the small screw 57. The position of the developer removing member 58 relative to the developing means holding frame 17 becomes fixed as the cylindrical positioning joggle 58*c,* which is coaxial with the screw hole 58*a* of the developer removing member 58, is fitted into the screw hole 26*c* of the metallic supporting portion 26*c* of the developer regulating member 26 (FIG. 7). Further, the attitude of the developer removing member 58 relative to the developing means holding frame 17 becomes fixed as the positioning joggle 17*t* of the developing means holding frame 17 for positioning the developer regulating member 26 is fitted into the elongated positioning hole 58*b* of the developer removing member 58, which is elongated in the direction roughly parallel to the developer regulating member 26 in a manner to be aligned with the cylindrical positioning joggle 58*a* of the developer removing member 58 (FIG. 6). Since the developer removing member 58 can be positioned and solidly secured with the use of the above described means for positioning and solidly securing the development blade 26 as described above, it is possible to achieve reduction in the size of the developer removing member 58, which leads to better special efficiency as well as cost reduction.

(Structure for Positioning Magnetic Sealing Member)

The position of the magnetic sealing member relative to the development roller is fixed by the above described developing means holding frame, elastic sealing member, and development roller bearing, More specifically, it is fixed by positioning the positioning hole 50*d* of the magnetic sealing member, and keeping the magnetic sealing member pressured so that the magnetic sealing member rotates about the axial line of the positioning hole 50*d,* as shown in FIG. 7. This positioning of the magnetic sealing member will be described next in more detail with reference to FIGS. 6, 7, 8, and 9.

Referring to FIG. 7, in terms of the cross sectional view perpendicular to the lengthwise direction of the development roller, both the magnet 50*a* and magnetic plate 50*b* have semicircular portions 50*e* (semicircular portion of magnetic sealing member), which hold the gap g1 from the development roller 18, and straight end portions 50*c* (which faces the developer removing member 58), which extend upward toward the developing means holding frame 17 from the top ends of the semicircular portions 50*e* at an angle relative to the line connecting its base portion and the center of the curvature of the semicircular portions 50*e.* As for the cross section in terms of a given plane parallel to the radius direction of the semicircular portions 50*e,* the magnet 50*a* is roughly square, and the combination of the magnet 50*a* and magnetic plate 50*b* is square. The magnet 50*a* has a semicircular positioning lobe 50*h,* which protrudes from the peripheral surface 50*f* of the magnet 50*a.* The semicircular positioning lobe 50*h* is provided with a positioning hole 50*d,* the axial line of which coincides with the axial line of the semicircular positioning lobe 50*h.* Referring to FIG. 11, the top end of the magnetic plate 50*b* is embedded in the straight portion 50*c* of the magnet 50*a.* On the outward side in terms of the lengthwise direction of the development roller, the magnetic plate 50*b* is flush with the magnet 50*a.*

Referring to FIGS. 7 and 10, the developing means holding frame 17 is provided with a magnetic sealing member attachment groove 17*k* (17*k*1, 17*k*2, and 17*k*3), which extends from the flat surface 7*f* to the bottom end of the arcuate portion (surface) 171 (e1). This groove 17*k* comprises an arcuate section 17*k*1 which follows the curvature of the arcuate surface 171 (FIG. 10), a straight vertical section 17*k*2 which follows the flat surface 17*f,* and a nondefinitively curved portion 17*k*3 in which the positioning lobe 50*h* (having positioning hole 50*d* coaxial with positional hole) of the magnetic sealing member 50 perfectly fits; the sections 17*k*1, 17*k*2, and 17*k*3 are continuous. The section 17*k*3 of the groove 17*k* is deeper than the section 17*k*1 of the groove 17*k,* cutting deeper into the developing means holding frame 17 from the bottom of the section 17*k*1. The width H (FIG. 8) of the groove 17*k* is made equal to that of the magnetic sealing member 50. Thus, as the magnetic scaling member 50 is fitted into the groove 17*k,* the position of the magnetic sealing member 50 relative to the development roller 18 in terms of the lengthwise direction of the development roller 18 becomes fixed. The depth of each section of the magnetic sealing member attachment groove 17*k* is made to be such that after the fitting of the magnetic sealing member 50 into the groove 17*k,* there will be a 0.1–0.7 mm gap between the bottom wall of each section of the groove 17*k* and the corresponding portion of the magnetic sealing member 50. In other words, a predetermined gap g2 (FIG. 7) is kept between the peripheral surface 50*f* of the magnetic sealing member 50 and the bottom surface of the groove 17*k* of the developing means holding frame 17. In order to prevent toner from leaking through this gap g2, the magnetic sealing member is magnetized so that its magnetic pole faces the peripheral surface of the development roller 18, and that toner is prevented from leaking by magnetic force. Incidentally, in order to enhance the effect of the magnetic force, the magnetic plate 50*b* may be configured so that it reaches the peripheral surface of the magnetic sealing member 50 to prevent, as on the development roller side, the magnetic force from spreading.

Next, the positioning of the magnetic sealing member 50 will be described in detail. Referring to FIG. 8, as the first cylindrical portion 55*d,* or the middle portion, of the step joggle, that is, the shaft for positioning/supporting the magnetic sealing member 50, protruding from the aforementioned development roller bearing, is fitted into the positioning hole 50*d* of the magnetic sealing member 50, the magnetic sealing member 50 is rotationally supported by the developer bearing 55. Further, the second cylindrical portion 55*e,* or the end portion, of the step joggle is fitted into the positioning hole 17*s,* which is in the inward lateral wall of the magnetic sealing member attachment groove 17*k,* with respect to the cartridge, in terms of the lengthwise direction, and the axial line or which coincides with that of the positioning hole 17*c* of tie developing means holding frame 17. As a result, the magnetic sealing member 50 is supported by the step joggle, or the magnetic sealing member 50 positioning/supporting shaft, which is secured to the developing means holding frame 17 by both lengthwise ends. By being secured to the developing means holding frame 17 by both lengthwise ends, the step joggle, or the magnetic sealing member 50 positioning/supporting shaft, is enabled to reliably support the magnetic sealing member 50 in spite of its relatively small diameter, contributing to the special efficiency. The positioning/supporting shaft Is likely to tilt due to its formation, whereas it is relatively easy to form the developing means holding frame 17 so that the axial lines of the positioning holes 17*c* and 17*s* of the developing means holding frame 17 coincide Thus, the above described structural arrangement assures that the magnetic sealing member 50 is kept precisely positioned in spite of the relatively small diameter of the magnetic sealing member positioning/supporting shaft.

Next, as for the positioning of the magnetic sealing member 50 relative to the developing means holding frame 17 in terms of its pivotal direction, it is fixed by placing the magnetic sealing member 50 in contact with the end surface 17*k*4, on the bottom side, of the arcuate section 17*k*1 of the magnetic sealing member attachment groove 17*k* of the developing means holding frame 17, that is, the end surface 17*k*4 which vertically extends to the bottom of the groove 17*k* from the elastic seal (unshown) anchoring surface 17*m*1 of the mandible-like portion 17*m* described before. The pressure F for assuring that the magnetic sealing member 50 is kept in contact with the bottom end surface 17*k*4 is mainly generated by the resiliency of the ear-like portion 51*b* of the elastic sealing member 51 kept compressed between the developer regulating member 26 and blade supporting portion 26*a*. With the presence of this pressure, it is ensured that the magnetic sealing member 50 is kept pressured in the direction to pivot clockwise about the axial line of the positioning hole 50*d,* so that the development roller and magnetic sealing member are precisely positioned relative to each other. Further, only the development roller bearing is involved in the positioning of the magnetic sealing member and development roller relative each other, minimizing the variation in the size of the gap g1, which manifests as one of the cumulative effects of the errors in component measurements, and therefore, affording the magnetic sealing member 50 a greater margin for error in terms of the toner leakage prevention performance. In the past, it was customary to measure the gap g1 during the cartridge assembly.

However, the above described structural arrangement drastically reduced the amount of the variation in the size of the gap g1, making it unnecessary to examine the gap g1. The usage of a part of the elastic sealing member 51 as the source for generating the pressure F makes it possible to eliminate the need for a component dedicated for generating the pressure F, reducing therefore the cost, while assuring that the magnetic sealing member 50 is precisely positioned. Further, the employment of a dielectric substance as the material for the elastic sealing member 51 enables the elastic sealing member 51 to play the rule of preventing electrical leakage, for example, when high voltage is applied to the metallic supporting portion of the development roller.

Next, referring to FIG. 10, the attachment of the magnetic sealing member will be described up to the point where the position of the magnetic sealing member becomes fixed.

First, the arcuate portion 50*e* and straight end portion 50*c* of the magnetic sealing member 50 are fitted into the arcuate section 17*k*1 and straight section 17*k*2, respectively, of the magnetic sealing member attachment groove 17*k* of the developing means holding frame 17 by moving the magnetic sealing member 50 in the direction indicated by an arrow mark D in FIG. 10; the magnetic sealing member 50 is pushed into the groove 17*k* until the inward surface of the arcuate portion 50*e,* in terms of its curvature, becomes roughly flush with the arcuate surface 171 (e1). Next, the first and second straight portions 51*c* and 51*a* (third sealing member) of the elastic sealing member 51 are pasted to the elastic seal anchoring surface 17*h,* that is, the end surface of the lengthwise rib, and the elastic seal anchoring surface 17*j,* respectively, of the developing means holding frame 17. Also the ear-like portion 51*b* of the elastic sealing member 51 is pasted to the straight end portion 50*c* of the magnetic sealing member 50. At this stage, the elastic sealing member anchoring surface 17*h* of the developing means holding frame 17, and the surface of the straight portion 50*c* of the magnetic sealing member 50, are not flush with each other. Therefore, in order to make it easier to paste the elastic sealing member 51 to both the surface 17*h* and the surface of the straight end portion 50*c,* the straight end portion of the magnetic sealing member 50 is provided with an inclined surface 50*g* (FIGS. 9 and 11). Incidentally, if necessary for the sake of material usage efficiency, the ear-like portion 51*b* and second straight portion 51*a* of the elastic sealing member 51 may be made discrete from the first straight portion 51*b.* Here, all that is required of the elastic sealing member 51 is to seal between the developing means holding frame 17 and developer regulating member 26. Therefore, it is not mandatory that the sealing member 51 is formed of an elastic substance. However, the second straight portion 51*a* of the sealing member 51, which is to be sandwiched between the straight end portion 50*c* of the magnetic sealing member 50 and the blade supporting portion 26*a* of the developer regulating member 26, must be enabled to apply pressure to the magnetic sealing member 50. Therefore, it must be formed of an elastic substance, whether it is formed as an integral part of the elastic sealing member 51 or a discrete part. As for the attachment of the developer regulating member 26, first, the developer regulating member 26 is placed in contact with the developing means holding frame 17 so that aforementioned joggle 17*t* fits into the positioning hole 26*d* of the blade supporting portion 26*a.* Next, the developer removing member 58 is placed in contact with the developer regulating member 26 so that the positioning joggle 58*c* of the developer removing member 58 fits into the screw hole 26*c* of the blade supporting portion 26*a.* Then, the small screw 57 is put through the screw hole 58*a,* or the center hole, of the positioning joggle 58*c,* and is screwed into the threaded screw hole 17*g,* solidly anchoring the blade supporting portion 26*a* to the flat surface 17*f.* As the small screw 57 is screwed into the threaded hole 17*g* of the developing means holding frame 17 in order to solidly attach the developer regulating member 26 to the developing means holding frame 17, the blade supporting portion 26*a* of the developer regulating member 26 causes the elastic sealing member 51 to be sandwiched and compressed by the developing means holding frame 17 and the arcuate portion 50*e* of the magnetic sealing member 50. At this stage, in terms of the lengthwise direction of the cartridge, the end portion of the blade supporting portion 26*a* faces the straight end portion 50*c* of the magnetic sealing member 50, with the presence of a space E between the two end portions. This space E is connected to the space between the blade portion 58*e* of the developer removing member 58 and the straight end portion 50*c* of the magnetic sealing member 50. Next, the development roller unit is temporarily positioned so that the arcuate portion 50*e* of the magnetic sealing member 50 and development roller 18 become coaxial. At this stage, the development roller 18 is prevented from coming into direct contact with the magnetic sealing member 50, by the resiliency of the elastic developer regulating portion 26*b* (elastic blade), being therefore prevented from being damaged by the magnetic sealing member 50 across its peripheral surface.

Lastly, the pair of development roller bearings 55 are attached to the corresponding lateral walls of the developing means holding frame 17 in the direction parallel to the lengthwise direction (drawing shows only one lengthwise end of the developing means holding frame 17; other end is virtually identical). More specifically, as described before with reference to FIG. 8, each development roller bearing 55 is solidly secured to the developing means holding frame 17 through the following steps: the joggle 55*c* of the development roller bearing 55 is fitted in the positioning hole 17*c;* the joggle 55*f* is fitted in the elongated hole 17*o* (vertically elongated in parallel to the plane of FIG. 8); the surface 55*g* of the development roller bearing 55 is placed in contact with the flat surface 17*p* of the developing means holding frame; and the small screws 56 (FIG. 10) are put through the screw holes 55*b* of the development roller bearing 55, and screwed into the threaded holes 17*q* and 17*r* in the flat surface 17*p* shown in FIG. 12. As a result, the magnetic sealing member 50 is precisely positioned, being enabled to pivot about the first cylindrical portion 55*d* of the step joggle, and the magnetic sealing member 50 is pivoted about the first cylindrical portion 55*d,* by the force generated by the resiliency of the elastic sealing member 51 sandwiched and compressed by the magnetic sealing member 50 and developer regulating member 26, so that the bottom end surface of the magnetic sealing member 50 comes into contact with the bottom end surface 17*k*4 of the groove 17*k* of the developing means holding frame 17, and is kept in contact therewith.

As is evident from the above description. this embodiment assures that the magnetic sealing member can be precisely positioned relative to the development roller using a simple assembly method.

(Measure Against Toner Leakage of Large Capacity Cartridge)

When the process cartridge is in use, the blade portion 58*e* of the developer removing member 58 is in contact with the peripheral surface of the development roller 18, extending in the direction counter to the moving direction of the peripheral surface of the development roller 18, as described before, and as the development roller 18 rotates, the toner on the peripheral surface of the development roller 18 is scraped away toward the center of the development roller 18 in terms of the lengthwise direction, by the edge 58*e*1 inclined relative to the axial line of the development roller 18. Here, "inclined" means that when the edge 58*e*1 is in contact with the peripheral surface of the development roller 18, the position of a given point of the contact line between the edge 58*e*1 and the peripheral surface of the development roller 18 does not align with another point of the contact line in the direction parallel to the axial line of the development roller 18; more specifically, assuming that a straight line is theoretically drawn on the peripheral surface of the development roller 18 in parallel to the axial line of the development roller 18, as the development roller 18 is rotated, the inward side of the edge 58*e*1 comes into contact with the theoretical line slightly later than the outward side of the edge 58*e*1. However, when there is a large amount of toner on the peripheral surface of the development roller 18, a certain amount of toner fails to be scraped away toward the center, and such toner accumulates on the surface of the blade portion 58*e,* which faces the straight end portion 50*c* of the magnetic sealing member 50. In the case of a process cartridge in accordance with the prior arts, the service life of which is relatively short, the amount of such toner which accumulates on the above described surface of the blade portion 58*e* throughout the service life of the cartridge is very small, creating no problem. However, in the case of a long-life process cartridge, the amount of such toner which accumulates on the surface of the blade portion 58*e,* which faces the straight end portion 50*c* of the magnetic scaling member 50, throughout the service life of the cartridge is relatively large. Therefore, there is a possibility that as the cumulative usage time increases, too much toner will accumulate on the blade portion 58*e,* and overflow outward of the developer removing member 58, into the internal space of the image forming apparatus.

Figure 21:
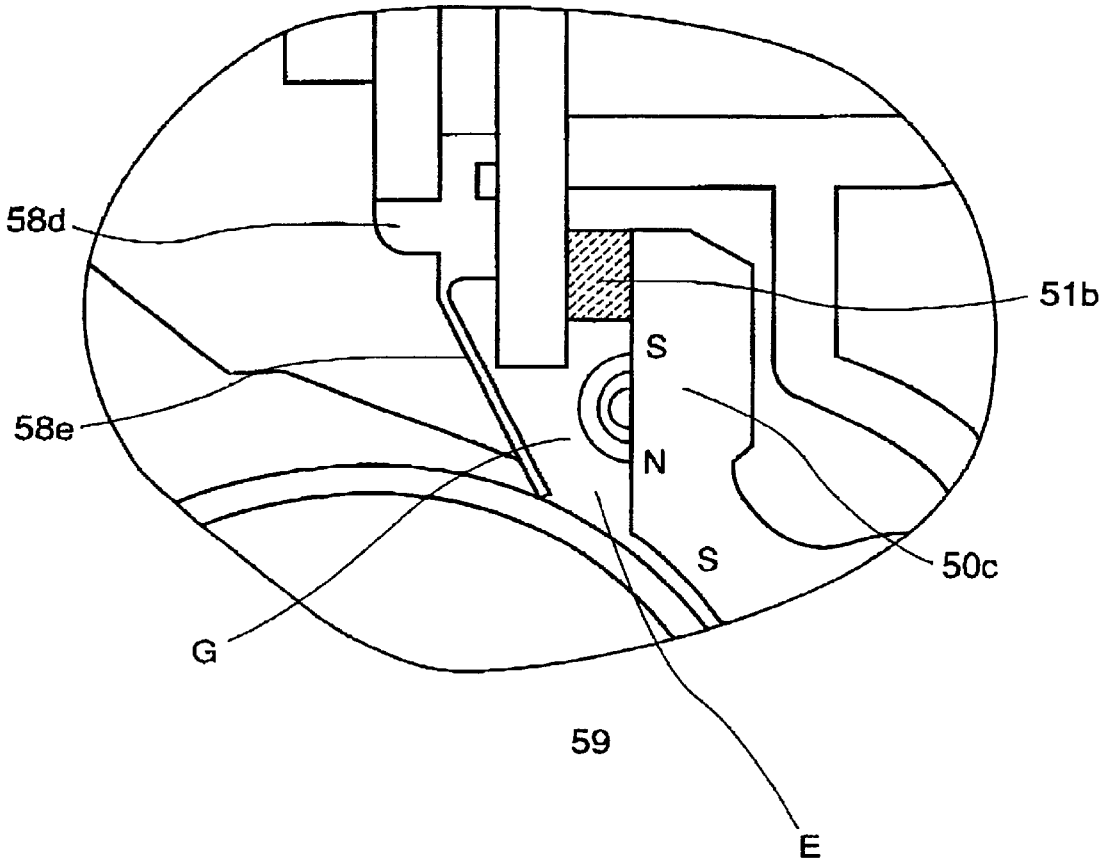
FIG. 21 is a sectional view illustrating an example in which a plurality of magnetic poles are provided at an end surface 50*c* of the magnetic sealing member.

Thus, in this embodiment, the space E is provided, as a toner storage space, between the straight end portion 50*c* of the magnetic sealing member 50 and the blade supporting portion 26*a* of the developer regulating member 26 (between the magnetic sealing member 50 and developer removing member 58) as shown in FIG. 7. In addition, even the straight end portion 50*c* of the magnetic sealing member 50 is magnetized. Therefore, the portion of the toner scraped away by the developer removing member 58, which otherwise might have leaked into the apparatus interior, collects in the space E; in other words, it does not leak into the apparatus interior. Further, the ear-like portion 51*b* of the aforementioned elastic sealing member 51, that is, the member for positioning and pressuring the magnetic sealing member 50, is positioned between the top end of the straight end portion of the magnetic sealing member 50 and the blade supporting portion 26*a,* blocking the top side of the space E, and therefore, preventing the toner from leaking from the top end of the space E. Even if the ear-like portion 51*b* is absent, the toner in the space E is retained therein by the magnetization of the straight end portion 50*c* or the magnetic sealing member 50, as long as the amount of the toner in the space E remains below a certain level. In particular, magnetizing the straight end portion 50*c* in a manner to provide the surface of the portion 50*c* with a plurality of magnetic poles makes it possible to form a magnetic flux G on the surface of the portion 50*c* as shown in FIG. 21 so that a larger amount of toner can be held in the space E; it is an effective means for preventing toner leakage.

As described, according to this embodiment, the level of protection against toner leakage can be raised without the need for additional components.

In order to raise the level of protection against toner leakage even higher, the structure shown in FIGS. 19 and 20 may be adopted. That is, a sealing member 59 (second sealing member) is to be pasted to the sealing member anchoring portion 17*u* of the developing means holding frame, which is virtually flush with the straight end portion 50*c* of the magnetic sealing member 50, so that the sealing member 59 contacts the straight end portion 50*c* (on the outward side, with respect to the space E, in terms of the lengthwise direction of the development roller). This sealing member 59 is a virtually cubic elastic member, the material for which is desired to be an inexpensive material such as foamed urethane or the like. By being pasted to the above described location, it overlaps 1–3 mm with the developer removing member 58 in the lengthwise direction of the development roller 18, and is compressed by the blade portion 58*e* of the developer removing member 58 as shown in FIG. 20. Thus, even when the space E is filled up with toner, the toner does not leak outward of the developer removing member 58 (does not leak from space E). At each end of the magnetic sealing member 50 in terms of the lengthwise direction of the cartridge, one side of the space E is blocked by the sealing member 59 (second sealing member), and the other side (side opposite to second sealing member) is blocked by the second straight portion 51*a* (third sealing member) of the elastic sealing member 51.

As evident from the above description, the addition of the single inexpensive component described above further raises the level of protection against toner leakage.

In the above description of this embodiment of the present invention, the present invention was described with reference to a developing apparatus mounted in a process cartridge. However, the present invention is also applicable to a cartridge comprising only a developing means.

While the invention has been described with reference to the structures disclosed herein, it is not confined to the details set forth, and this application is intended to cover such modifications or changes as may come within the purposes of the improvements or the scope of the following claims.

What is claimed is:

1. A developing apparatus comprising:

a container, having an opening, for containing magnetic developer;

a developer carrying member, rotatably disposed in the opening, for carrying the developer;

a magnetic sealing member disposed so as to be spaced from a peripheral surface of said developer carrying member;

a removing member, disposed so as to contact said developer carrying member, for removing the developer from the peripheral surface of said developer carrying member, said removing member also being disposed so as to be adjacent to an end, in a peripheral direction of said developer carrying member, of said magnetic sealing member; and a second sealing member for limiting movement of the developer from a space between said magnetic sealing member and said removing member toward a longitudinal end of said developer carrying member.

2. A developing apparatus according to claim 1, wherein said second sealing member is made of elastic material.

3. A developing apparatus according to claim 2, wherein said second sealing member is disposed closer to the longitudinal end than to the space and is compressed by said removing member.

4. A developing apparatus according to claim 3, further comprising a third sealing member, which is provided in the space at a side opposite from a side in which said second sealing member is provided.

5. A developing apparatus according to claim 1, further comprising a layer thickness regulating member for regulating a layer thickness of the developer, wherein a metal plate supporting said layer thickness regulating member is disposed between said magnetic sealing member and said removing member.

6. A developing apparatus according to claim 5, further comprising an elastic member disposed between said metal plate and said magnetic sealing member.

7. A developing apparatus according to claim 6, wherein a position of said magnetic sealing member with respect to a direction perpendicular to the longitudinal direction is determined by a restoring force of said elastic member.

8. A developing apparatus according to claim 1, wherein said removing member is disposed so as to be adjacent to a developer outlet portion of the peripheral surface of said developer carrying member.

9. A developing apparatus according to claim 1, wherein a surface of said magnetic sealing member opposed to said removing member includes a magnetic pole.

10. A developing apparatus according to claim 9, wherein more than two of said magnetic pole are provided.

11. A developing apparatus according to claim 1, wherein the developer is toner, and said magnetic sealing member includes a magnet for forming a concentrated magnetic field.

12. A developing apparatus according to claim 1, wherein said apparatus is contained in a cartridge containing an image bearing member for carrying an electrostatic latent image, and said cartridge is detachably mountable to a main assembly of an image forming apparatus.

13. A developing apparatus comprising:

a container, having an opening, for containing magnetic developer;

a developer carrying member, rotatably disposed in the opening, for carrying the developer;

a magnetic sealing member disposed so as to be spaced from a peripheral surface of said developer carrying member; and a removing member, disposed so as to contact said developer carrying member, for removing the developer from the surface of said developer carrying member, said removing member also being disposed so as to be adjacent to an end, in a peripheral direction of said developer carrying member, of said magnetic sealing member, wherein a surface facing said removing member and without facing the peripheral surface of said developer carrying member of said magnetic sealing member includes two or more magnetic poles.

14. A developing apparatus according to claim 13, wherein the developer is toner, and said magnetic sealing member includes a magnet for forming a concentrated magnetic field.

15. A developing apparatus according to claim 13, wherein said removing member is disposed so as to be adjacent to a developer outlet portion of the peripheral surface of said developer carrying member.

16. A developing apparatus according to claim 13, wherein said developing apparatus is contained in a cartridge containing an image bearing member for carrying an electrostatic latent image, and said cartridge is detachably mountable to a main assembly of an image forming apparatus.

* * * * *

UNITED STATES PATENT AND TRADEMARK OFFICE

CERTIFICATE OF CORRECTION

PATENT NO. : 6,708,010 B2
DATED : March 16, 2004
INVENTOR(S) : Shigeo Miyabe et al.

It is certified that error appears in the above-identified patent and that said Letters Patent is hereby corrected as shown below:

Column 1,
Line 66, “the retain” should read -- to retain --.

Column 2,
Line 26, “proposes” should read -- propose --; and
Line 33, “amount” should read -- number --.

Column 3,
Line 59, “Loner” should read -- toner --.

Column 4,
Line 15, “dismounted” should read -- is dismounted --; and
Line 23, “Image” should read -- image --.

Column 9,
Lines 21, 23 and 25, “flatted” should read -- flattened --.

Column 10,
Line 27, “bush” should read -- bushing --.

Column 11,
Line 11, “It” should read -- it --.

Column 12,
Line 17, “It” should read -- it --.

Column 13,
Line 10, “cross sectional” should read -- cross-sectional --.

UNITED STATES PATENT AND TRADEMARK OFFICE

CERTIFICATE OF CORRECTION

PATENT NO. : 6,708,010 B2
DATED : March 16, 2004
INVENTOR(S) : Shigeo Miyabe et al.

It is certified that error appears in the above-identified patent and that said Letters Patent is hereby corrected as shown below:

Column 14,
Line 30, “Is” should read -- is --; and
Line 34, “coincide” should read -- coincide. --.

Column 19,
Line 27, “pole” should read -- poles --.

Signed and Sealed this

Thirteenth Day of July, 2004

JON W. DUDAS
*Acting Director of the United States Patent and Trademark Office*